US010434788B2

(12) United States Patent
Tamaki

(10) Patent No.: US 10,434,788 B2
(45) Date of Patent: Oct. 8, 2019

(54) LIQUID STORAGE UNIT

(71) Applicant: BROTHER KOGYO KABUSHIKI KAISHA, Nagoya-shi, Aichi-ken (JP)

(72) Inventor: Shuichi Tamaki, Nagoya (JP)

(73) Assignee: BROTHER KOGYO KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 16/023,193

(22) Filed: Jun. 29, 2018

(65) Prior Publication Data

US 2019/0001688 A1 Jan. 3, 2019

(30) Foreign Application Priority Data

Jun. 30, 2017 (JP) ..... 2017-128191

(51) Int. Cl.
*B41J 2/175* (2006.01)

(52) U.S. Cl.
CPC ..... *B41J 2/17553* (2013.01); *B41J 2/17513* (2013.01); *B41J 2/17523* (2013.01); *B41J 2/17533* (2013.01); *B41J 2002/17516* (2013.01)

(58) Field of Classification Search
CPC .... B41J 2/175; B41J 2/17503; B41J 2/17513; B41J 2/17523; B41J 2/17533; B41J 2/17553; B41J 2002/17516
See application file for complete search history.

(56) References Cited

U.S. PATENT DOCUMENTS 5,400,066 A * 3/1995 Matsumoto ..... B41J 2/17513 347/84
6,102,517 A * 8/2000 Kobayashi ..... B41J 2/175 347/23
6,220,702 B1 4/2001 Nakamura et al.
6,929,363 B2 * 8/2005 Sakai ..... B41J 2/17533 347/108

(Continued)

FOREIGN PATENT DOCUMENTS

EP 0418828 A1 3/1991
EP 0761450 A2 3/1997

(Continued)

OTHER PUBLICATIONS

Extended European Search Report issued in connection with European Patent Application No. 18179377.9, dated Nov. 12, 2018. (7 pages).

*Primary Examiner* — Anh T Vo
(74) *Attorney, Agent, or Firm* — K&L Gates LLP

(57) ABSTRACT

A liquid storage unit includes a liquid container, a spout, a plate-shaped member, and a bag. The liquid container is provided with a storage portion configured to store a liquid inside of a flexible sheet. The spout is provided on the liquid container, and is configured to supply the liquid stored in the storage portion to an inkjet printer in a state in which the spout is connected to the inkjet printer. The plate-shaped member is configured to sandwich at least a portion of an end portion of the liquid container from both sides in an orthogonal direction that is orthogonal to a surface of the sheet. The bag is configured to enclose the liquid container and the plate-shaped member. An inside surface of the bag contacts the plate-shaped member when the inside of the bag is in a depressurized state.

18 Claims, 10 Drawing Sheets

(56) References Cited

U.S. PATENT DOCUMENTS

| | | | | |
|---|---|---|---|---|
| 7,008,050 | B2 * | 3/2006 | Childers | B41J 2/17506 347/85 |
| 7,048,348 | B2 * | 5/2006 | Mochizuki | B41J 2/17546 347/19 |
| 7,093,710 | B2 * | 8/2006 | Shimizu | B41J 2/17533 206/213.1 |
| 7,284,806 | B2 | 10/2007 | Nakamura | |
| 8,061,827 | B2 * | 11/2011 | Iino | B41J 2/175 347/19 |
| 2004/0018387 | A1 | 9/2004 | Toyoda et al. | |
| 2004/0183874 | A1 | 9/2004 | Toyoda et al. | |
| 2007/0040859 | A1 * | 2/2007 | Kimura | B41J 2/175 347/7 |
| 2015/0273845 | A1 | 10/2015 | Takagiwa | |

FOREIGN PATENT DOCUMENTS

| | | | |
|---|---|---|---|
| JP | H11-286120 | A | 10/1999 |
| JP | 2001-058674 | | 3/2001 |
| JP | 2004-114557 | A | 4/2004 |
| JP | 2015-199338 | A | 11/2015 |

* cited by examiner

LIQUID STORAGE UNIT

CROSS-REFERENCE TO RELATED APPLICATION

This application claims priority to Japanese Patent Application No. 2017-128191 filed on Jun. 30, 2017, the disclosure of which is herein incorporated by reference in its entirety.

BACKGROUND

The present disclosure relates to a liquid storage unit that stores a liquid.

A liquid container is known, which is formed by connecting peripheral edge portions of two flexible resin sheets by thermal welding. Further, a packaging of an ink package is known, in which a storage case containing an ink package is enclosed in a wrapper and air is sucked out of the wrapper. With above packaging, the degree of deaeration of the ink package is maintained by depressurizing the space formed between the ink package and the storage case.

SUMMARY

However, when the liquid container is used as the ink package of the packaging described above, the peripheral edge portion of the liquid container is not fixed inside the packaging. Therefore, the peripheral edge portion of the liquid container may bend.

Various embodiments of the general principles described herein provide a liquid storage unit in which the peripheral edge portion of a liquid container will not easily bend.

Embodiments herein provide a liquid storage unit includes a liquid container, a spout, a plate-shaped member, and a bag. The liquid container is provided with a storage portion that is configured to store a liquid inside a flexible sheet. The spout is provided on the liquid container, and is configured to supply the liquid stored in the storage portion to an inkjet printer in a state in which the spout is connected to the inkjet printer. The plate-shaped member is configured to sandwich at least a portion of an end portion of the liquid container from both sides in an orthogonal direction that is orthogonal to a surface of the sheet. The bag is configured to enclose the liquid container and the plate-shaped member. An inside surface of the bag contacts the plate-shaped member in a state in which the inside of the bag is depressurized.

Embodiments herein also provide a liquid storage unit includes a liquid container, a spout, a plate-shaped member, and a bag. The liquid container is provided with a storage portion that is configured to store a liquid inside a flexible sheet. The spout is provided on the liquid container. The plate-shaped member is configured to sandwich at least a portion of an end portion of the liquid container from both sides in an orthogonal direction that is orthogonal to a surface of the sheet. The bag is configured to enclose the liquid container and the plate-shaped member. An inside surface of the bag contacts the plate-shaped member in a state in which the inside of the bag is depressurized.

BRIEF DESCRIPTION OF THE DRAWINGS

Embodiments will be described below in detail with reference to the accompanying drawings in which.

DETAILED DESCRIPTION

Figure 1:
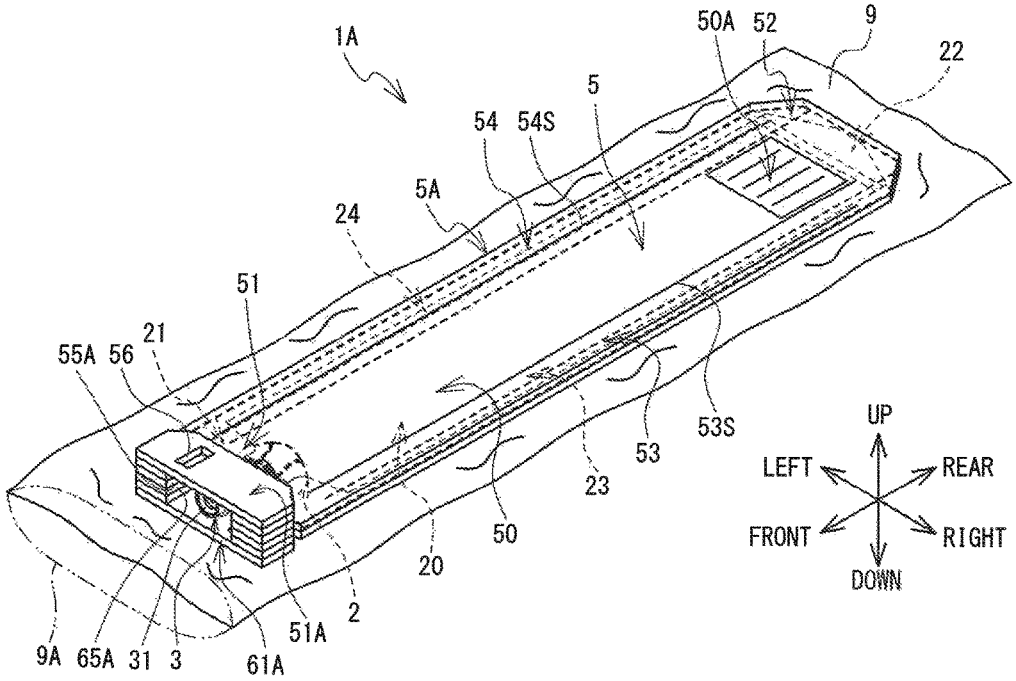
FIG. 1 is a perspective view of a liquid storage unit.

A liquid storage unit 1A according to an embodiment of the present disclosure will be described with reference to the drawings. The liquid storage unit 1A shown in FIG. 1 has a liquid container 2 to be mounted in a first cartridge 4 (refer to FIG. 6). The first cartridge 4 to which the liquid container 2 has been mounted is installed in an inkjet printer (not shown in the drawings). When the first cartridge 4 is installed in the inkjet printer, the liquid container 2 supplies liquid stored in a storage portion 20 to the inkjet printer. The inkjet printer prints by discharging liquid onto the surface of cloth such as a T-shirt, for example. The liquid is ink, for example, and the inkjet printer discharges the ink when printing.

[Outline of Liquid Storage Unit 1A]

Figure 2:
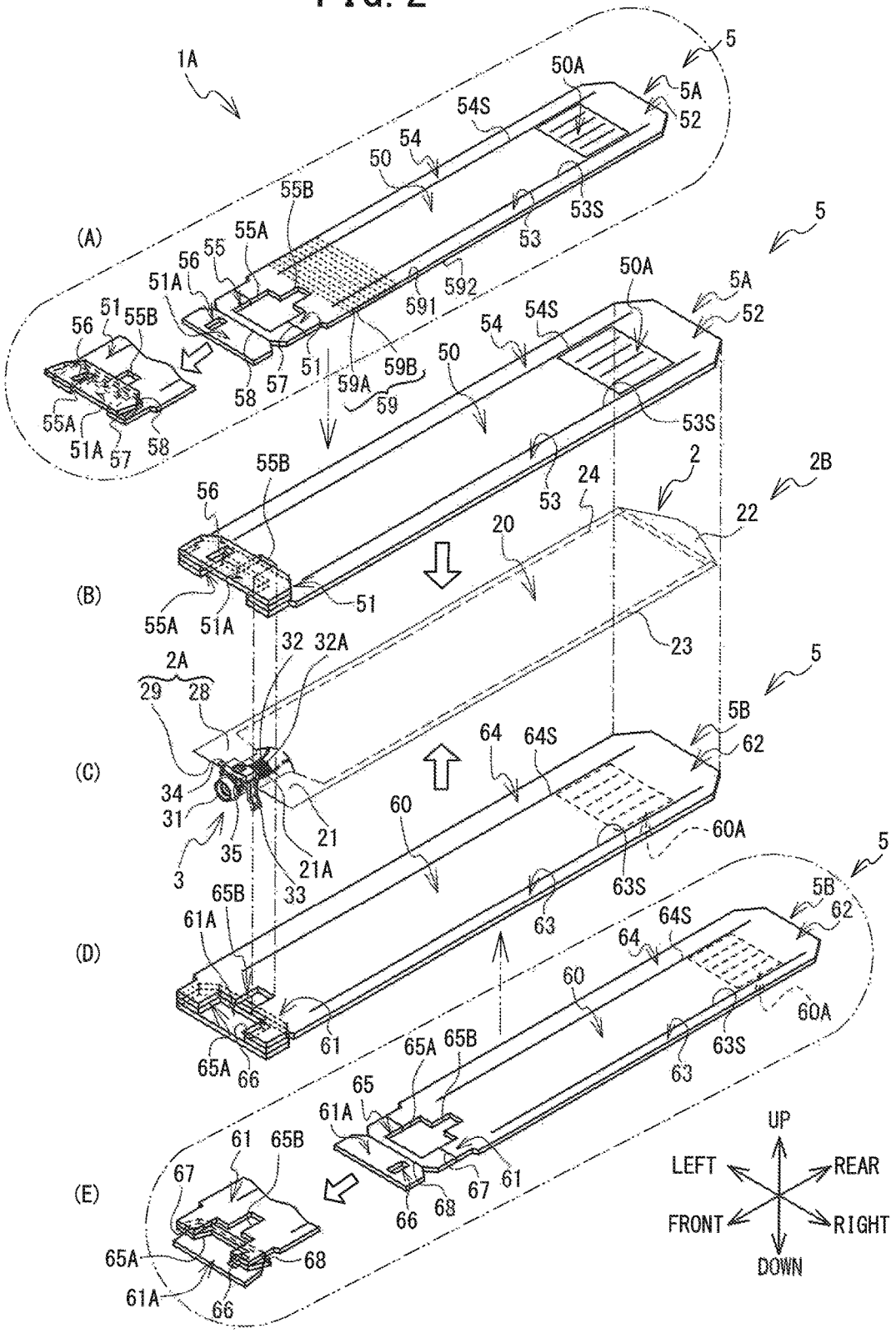
FIG. 2 is an exploded perspective view of the liquid storage unit excluding a bag.

As shown in FIG. 1, the liquid storage unit 1A includes the liquid container 2, plate-shaped members 5, and a bag 9. With the liquid storage unit 1A, the liquid container 2 is enclosed in the bag 9 in a state in which the liquid container 2 is sandwiched by the plate-shaped members 5. The plate-shaped members 5 inhibit the peripheral end portion of the liquid container 2 from bending during transport and the like. After being taking out of the bag 9 in a state in which the liquid container 2 is sandwiched by the plate-shaped members 5, the liquid container 2 is removed from the plate-shaped members 5 and mounted to the first cartridge 4 shown in FIG. 6. Hereinafter, the side inclined upward and to the left, the side inclined downward and to the right, the side inclined downward and to the left, the side inclined upward and to the right, the upper side, and the lower side in FIG. 1 will be defined as the left side, the right side, the front side, the rear side, the upper side, and the lower side of the liquid storage unit 1A. FIG. 2(A) shows a plate-shaped member 5A before being bent at notches 57 and 58, described later, and a front side portion of the plate-shaped member 5A after being bent at the notches 57 and 58. FIG. 2(B) shows the plate-shaped member 5A after being bent at the notches 57 and 58 (refer to FIG. 2(A)). FIG. 2(C) shows the liquid container 2. FIG. 2(D) shows a plate-shaped member 5B after being bent at notches 67 and 68, described later, (refer to FIG. 2(E)). FIG. 2(E) shows the plate-shaped member 5B before being bent at the notches 67 and 68, and a front side portion of the plate-shaped member 5B after being bent at the notches 67 and 68.

[Liquid Container 2]

Figure 3:
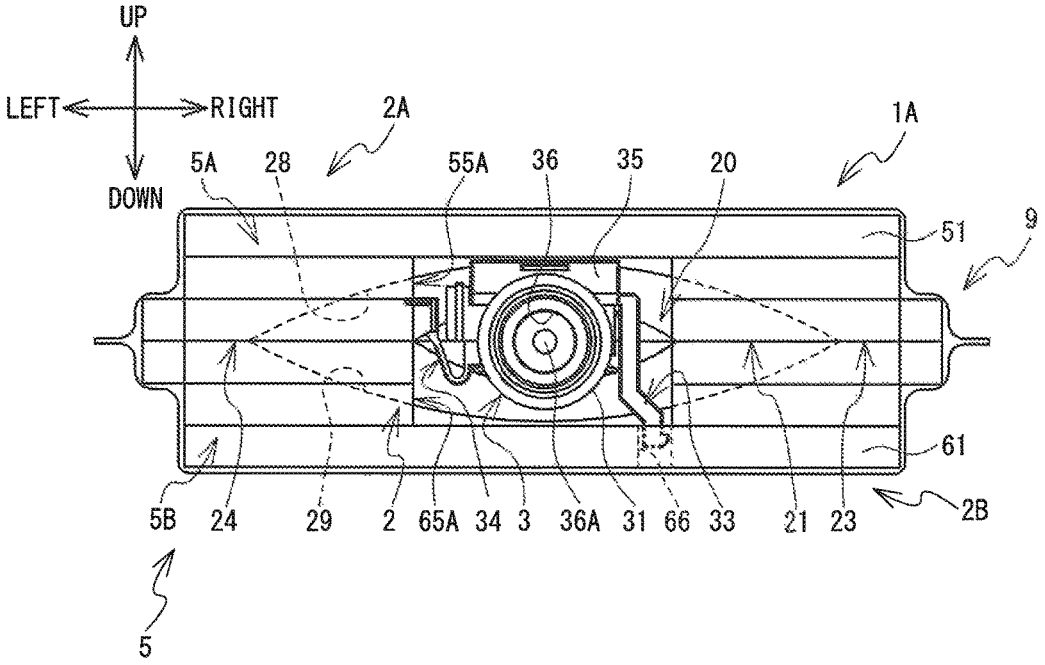
FIG. 3 is a front view of the liquid storage unit.

As shown in FIG. 2(C), the liquid container 2 has flexible rectangular-shaped resin sheets 28 and 29. The liquid container 2 is formed by thermally welding the peripheral edge portions of the sheets 28 and 29 together in a state in which respective one surfaces of the sheets 28 and 29 face each other in the up-down direction. The sheet 28 is arranged above the sheet 29. The respective surfaces of the sheets 28 and 29 are orthogonal to the up-down direction. The longitudinal direction of each of the sheets 28 and 29 extends in the front-rear direction, and the lateral direction of each of the sheets 28 and 29 extends in the left-right direction. The sheets 28 and 29 will be collectively referred to as sheets 2A. Of the peripheral edge portions where the sheets 2A are thermally welded, the portions on the front side, the rear side, the right side, and the left side will be referred to as a first container end portion 21, a second container end portion 22, a third container end portion 23, and a fourth container end portion 24. The front side of the first container end portion 21 extends along the left-right direction. The right side of the third container end portion 23 and the left side of the fourth container end portion 24 each extend along the front-rear direction. The right side and the left side of the second container end portion 22 have a tapered shape, so the length in the left-right direction of the second container end portion 22 becomes shorter toward the rear. The first container end portion 21, the second container end portion 22, the third container end portion 23, and the fourth container end portion 24 will be collectively referred to as container end portions 2B. The storage portion 20 is a space formed inside the sheets 2A. The storage portion 20 is surrounded by the container end portions 2B. The storage portion 20 stores ink. As shown in FIG. 3, when the storage portion 20 stores the ink, the sheets 28 and 29 bend and separate in the up-down direction.

As shown in FIG. 2(C), a spout 3 is provided on the first container end portion 21 of the sheets 2A. When the first cartridge 4 (refer to FIG. 6), in a state in which the liquid container 2 is mounted to the first cartridge 4, is installed in the inkjet printer, that is, in a state in which the inkjet printer and the spout 3 are connected, the spout 3 is able to supply the ink stored in the storage portion 20 to the inkjet printer. The spout 3 includes a main body 31, an insertion portion 32, a first spout engaging portion 33, a second spout engaging portion 34, and a holder 35. The main body 31 has a cylindrically-shaped front portion, and a rear portion that extends from the front portion toward the rear side. The insertion portion 32 has a cylindrical shape in which the outer diameter is shorter than the outer diameter of the front portion of the main body 31, and extends toward the rear from the rear end portion of the main body 31. The first container end portion 21 and the sheets 28 and 29 are welded together in a state in which the insertion portion 32 is inserted between the sheets 28 and 29 that form the first container end portion 21. A rear end portion 32A of the insertion portion 32 is arranged inside the storage portion 20. Of the first container end portion 21, the portion that is welded to the insertion portion 32 of the spout 3 will be referred to as a connection portion 21A.

As shown in FIG. 3, the spout 3 has a circular through-hole 36 that passes through the inside of the main body 31 and the insertion portion 32 (refer to FIG. 2(C)) in the front-rear direction. A rear end portion of the through-hole 36 is connected to the storage portion 20. A rubber plug 36A is inserted into the through-hole 36. The rubber plug 36A blocks the through-hole 36 of the spout 3. Therefore, the storage portion 20 stores ink inside the storage portion 20 in a tightly sealed state.

The first spout engaging portion 33, the second spout engaging portion 34, and the holder 35 are provided on a rear portion of the main body 31 of the spout 3. The first and second spout engaging portions 33 and 34 fix the position of the spout 3 with respect to the first cartridge 4. The first spout engaging portion 33 is rod-shaped and extends downward from the right end portion of the rear portion of the main body 31. The second spout engaging portion 34 has a bent plate shape. The second spout engaging portion 34 extends downward from the left end portion of the rear portion of the main body 31, and then bends at a lower end portion of the second spout engaging portion 34 and extends to the left and upward. The lower end portion of the first spout engaging portion 33 extends lower than the lower end portion of the second spout engaging portion 34. The first spout engaging portion 33 and the second spout engaging portion 34 engage with engaged portions 48 and 49 (refer to FIG. 6) provided on the first cartridge 4 in a state in which the liquid container 2 is mounted to the first cartridge 4 (refer to FIG. 6). The holder 35 is provided on an upper end portion of the rear portion of the main body 31. The holder 35 has a box shape and holds an electric circuit board (not shown in the drawings). Note that the first spout engaging portion 33 and the second spout engaging portion 34 have different shapes, and the positional relationship between the first spout engaging portion 33 and the second spout engaging portion 34 and the type of ink correspond, for example. That is, when the liquid container 2 that stores white ink is viewed from the front, the first spout engaging portion 33 is arranged to the left of the spout 3, and the second spout engaging portion 34 is arranged to the right of the spout 3, for example. Also, when the liquid container 2 that stores color ink is viewed from the front, the second spout engaging portion 34 is arranged to the left of the spout 3, and the first spout engaging portion 33 is arranged to the right of the spout 3, for example. Therefore, because the first spout engaging portion 33 and the second spout engaging portion 34 have different shapes, a user can be prevented from installing the first spout engaging portion 33 and the second spout engaging portion 34 to the engaged portions 48 and 49 in the wrong orientation. Also, when the liquid container 2 is viewed from the front, the user is able to determine the type of liquid stored in the liquid container 2 by checking the positional relationship between the first spout engaging portion 33 and the second spout engaging portion 34.

Figure 5:
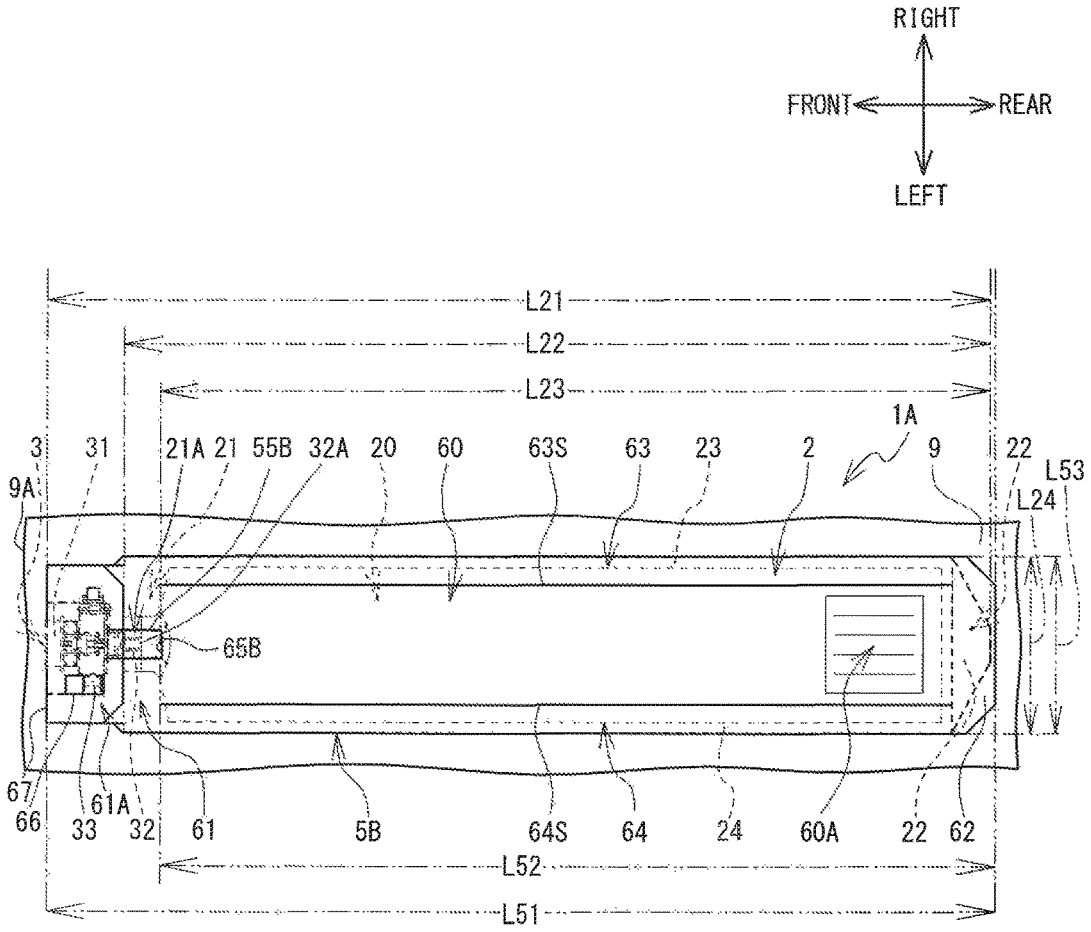
FIG. 5 is a plan view as seen from below the liquid storage unit.

As shown in FIG. 5, a distance L21 denotes the length in the front-rear direction between the front edge of the spout 3 and the rear edge of the second container end portion 22. A distance L22 denotes the length in the front-rear direction between the front edge of the first container end portion 21 and the rear edge of the second container end portion 22. A distance L23 denotes the length in the front-rear direction between the rear edge of the rear end portion 32A of the insertion portion 32 of the spout 3 and the rear edge of the second container end portion 22. A distance L24 denotes the length in the left-right direction between the right side of the third container end portion 23 and the left side of the fourth container end portion 24.

[Plate-shaped Members 5]

As shown in FIG. 2(A) and FIG. 2(E), the plate-shaped members 5 include the plate-shaped members 5A and 5B. The plate-shaped members 5A and 5B are made of cardboard having the same shape. The upper surface and lower surface of each of the plate-shaped members 5 are orthogonal to the up-down direction. The plate-shaped member 5A is arranged on the upper side of the liquid container 2 (refer to FIG. 2(B)). The plate-shaped member 5B is arranged on the lower side of the liquid container 2 (refer to FIG. 2(D)). The liquid container 2 is sandwiched by the plate-shaped member 5A from above and by the plate-shaped member 5B from below. That is, the plate-shaped members 5A and 5B sandwich the liquid container 2 from both sides in the up-down direction. The plate-shaped members 5A and 5B will collectively be referred to as the plate-shaped members 5. Hereinafter, the plate-shaped member 5A will be described in detail, and the description of the plate-shaped member 5B will be simplified.

Figure 4:
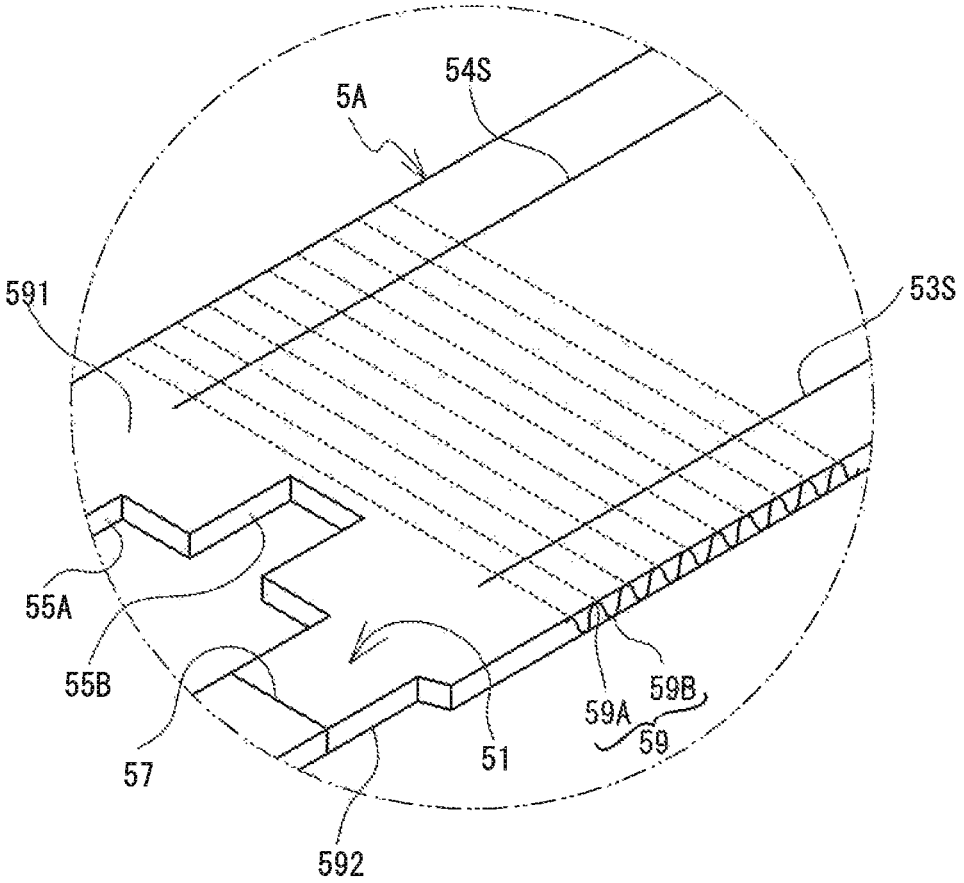
FIG. 4 is an enlarged view of the area near a first plate end portion of a plate-shaped member.

As shown in FIG. 2(A), the plate-shaped member 5A has a rectangular shape. The longitudinal direction of the plate-shaped member 5A extends in the front-rear direction, and the lateral direction of the plate-shaped member 5A extends in the left-right direction. As shown in FIG. 4, the plate-shaped member 5A has a core 59 between an upper side liner 591 and a lower side liner 592. The core 59 has a wavy shape which has mountain portions 59A and valley portions 59B. The mountain portions 59A and the valley portions 59B are arranged each extending in the left-right direction and alternating in the front-rear direction.

As shown in FIG. 2(A), a slit 53S is provided in a right end portion of the plate-shaped member 5A, and extends in the front-rear direction and runs between a front end portion and a rear end portion of the plate-shaped member 5A. A slit 54S is provided in a left end portion of the plate-shaped member 5A, and extends in the front-rear direction and runs between the front end portion and the rear end portion of the plate-shaped member 5A. Of the plate-shaped member 5A, the portion farther forward than the front end portions of the slits 53S and 54S in the front-rear direction will be referred to as a first plate end portion 51, and the portion farther toward the rear than the rear end portions of the slits 53S and 54S will be referred to as a second plate end portion 52. Of the plate-shaped member 5A, the portion to the right of the slit 53S in the left-right direction will be referred to as a third plate end portion 53, and the portion to the left of the slit 54S will be referred to as a fourth plate end portion 54. Of the plate-shaped member 5A, the portion sandwiched between the slits 53S and 54S in the left-right direction will be referred to as a plate center portion 50.

Through-holes 55 and 56 are provided in the first plate end portion 51 of the plate-shaped member 5A. The through-hole 55 has a polygonal shape, and includes a main portion 55A and a plate engaging portion 55B. The main portion 55A has a square shape. The main portion 55A is a recessed portion (in a plan view) that is provided at an end portion on the front side of the plate-shaped member 5A and is recessed toward the rear. The plate engaging portion 55B has a rectangular shape, and is a recessed portion (in a plan view) that is recessed toward the rear from the end portion on the front side of the plate-shaped member 5A. More specifically, the plate engaging portion 55B extends toward the rear from the center in the left-right direction of the rear end portion of the main portion 55A. The longitudinal direction of the plate engaging portion 55B extends in the front-rear direction, and the lateral direction of the plate engaging portion 55B extends in the left-right direction. With the plate engaging portion 55B, the length in the longitudinal direction of the plate engaging portion 55B from the end portion on the front side of the plate-shaped member 5A is the same as the length in the front-rear direction of the insertion portion 32 of the spout 3. The length in the lateral direction of the plate engaging portion 55B is approximately ⅓ the length of one edge of the main portion 55A, and is the same as the length in the left-right direction of the insertion portion 32 of the spout 3. That is, the plate engaging portion 55B is a through-hole that has the same shape as a portion (the insertion portion 32) of the spout 3. More specifically, the length in the left-right direction of the recessed portion, which is the plate engaging portion 55, is the same or longer than the length of the front end portion including the spout 3 and the first and second spout engaging portions 33 and 34 in the left-right direction. Therefore, the plate engaging portion 55B surrounds the insertion portion 32 of the spout 3 in a state in which the plate-shaped member 5A sandwiches the liquid container 2 from above. Note that the length in the left-right direction of the recessed portion, which is the plate engaging portion 55, may be longer than the length of the front end portion including the spout 3 and the first and second spout engaging portions 33 and 34 in the left-right direction. The through-hole 56 has a rectangular shape, and is provided at the front of the through-hole 55 and to the left of the center in the left-right direction of the first plate end portion 51. The longitudinal direction of the through-hole 56 extends in the front-rear direction, and the lateral direction of the through-hole 56 extends in the left-right direction.

The notches 57 and 58 are provided in the first plate end portion 51 of the plate-shaped member 5A, and facilitate bending of the plate-shaped member 5A. The notch 57 is formed by half-cutting the lower surface of the first plate end portion 51. The notch 57 extends in the left-right direction and passes through a position in the center in the front-rear direction of the through-hole 55. The notch 58 is formed by half-cutting the upper surface of the first plate end portion 51. The notch 58 extends in the left-right direction and passes through a position between the through-holes 55 and 56. The portion of the first plate end portion 51 that is in front of the notch 58 will be referred to as a leading end portion 51A. The first plate end portion 51 bends at the notch 57 in the direction in which the upper surfaces of the plate-shaped member 5A come close to each other, and bends at the notch 58 in a direction in which the lower surfaces of the plate-shaped member 5A come close to each other. As shown in FIG. 2(B), when the first plate end portion 51 is bent at the notches 57 and 58, the plate-shaped member 5A forms a space that is surrounded by the main portion 55A of the through-hole 55, on the lower side of the leading end portion 51A of the first plate end portion 51.

The left side and the right side of the second plate end portion 52 of the plate-shaped member 5A have a tapered shape. The right side of the second plate end portion 52 extends toward the rear and to the left at an angle. The left side of the second plate end portion 52 extends toward the rear and to the right at an angle. Therefore, the length in the left-right direction of the second plate end portion 52 becomes shorter toward the rear.

Liquid information 50A is printed on the upper surface near the second plate end portion 52 of the plate center portion 50 of the plate-shaped member 5A. The liquid information 50A shows information relating to the ink stored in the storage portion 20 of the liquid container 2. Specific examples of the information relating to the ink include ink color, model number, raw materials, use conditions, expiration date, and the like.

As shown in FIG. 2(E), a slit 63S is provided in a right end portion of the plate-shaped member 5B and extends in the front-rear direction, and a slit 64S is provided in a left end portion of the plate-shaped member 5B and extends in the front-rear direction. Note that the plate-shaped member 5B may be the same as the plate-shaped member 5A. At this time, the plate-shaped member 5B is arranged upside down with respect to the plate-shaped member 5A. The slit 63S corresponds to the slit 54S in the plate-shaped member 5A, and the slit 64S corresponds to the slit 53S in the plate-shaped member 5A. A first plate end portion 61 is a portion of the plate-shaped member 5B that is in front of the front end portion of the slits 63S and 64S in the front-rear direction, and a second plate end portion 62 is a portion to the rear of the rear end portion of the slits 63S and 64S. In the plate-shaped member 5B, a third plate end portion 63 is a portion to the right of the slit 63S in the left-right direction, and a fourth plate end portion 64 is a portion to the left of the slit 64S. In the plate-shaped member 5B, a plate center portion 60 is a portion sandwiched between the slits 63S and 64S in the left-right direction. Liquid information 60A may be printed near the second plate end portion 62 on the lower surface of the plate center portion 60. At this time, the liquid information 60A corresponds to the liquid information 50A of the plate-shaped member 5A.

Through-holes 65 and 66 are provided in the first plate end portion 61 and correspond to the through-holes 55 and 56 in the plate-shaped member 5A. A main portion 65A and a plate engaging portion 65B of the through-hole 65 correspond to the main portion 55A and the plate engaging portion 55B of the through-hole 55, respectively, in the plate-shaped member 5A. The through-hole 66 is provided at the front of the through-hole 65 and to the right of the center in the left-right direction of the first plate end portion 61. The left side and the right side of the second plate end portion 62 have a tapered shape.

The notches 67 and 68 are provided in the first plate end portion 61 and correspond to the notches 57 and 58, respectively, in the plate-shaped member 5A. A leading end portion 61A is a portion of the first plate end portion 61 that is in front of the notch 68. The plate-shaped member 5B bends at the notch 67 in the direction in which the lower surfaces of the plate-shaped member 5B come close to each other, and bends at the notch 68 in a direction in which the upper surfaces of the plate-shaped member 5B come close to each other. As shown in FIG. 2(D), when the first plate end portion 61 is bent at the notches 67 and 68, the plate-shaped member 5B forms a space that is surrounded by the main portion 65A of the through-hole 65, on the upper side of the leading end portion 61A of the first plate end portion 61.

As shown in FIG. 5, a distance L51 denotes the length in the front-rear direction between the notch 67 in the first plate end portion 61 and the rear edge of the second plate end portion 62 of the plate-shaped member 5B. Also, the length in the front-rear direction between the notch 57 in the first plate end portion 51 and the rear edge of the second plate end portion 52 (refer to FIG. 2) of the plate-shaped member 5A is denoted by the distance L51. The distance L21 denotes the length in the front-rear direction between the front edge of the spout 3 and the rear edge of the second container end portion 22 of the liquid container 2. The distance L51 is slightly longer than the distance L21 (L51>L21). The distance L22 denotes the length in the front-rear direction between the front edge of the first container end portion 21 and the rear edge of the second container end portion 22. The distance L51 is longer than the distance L22 (L51>L22). A distance L52 denotes the length in the front-rear direction between the rear end portion of the plate engaging portion 65B and the rear edge of the second plate end portion 62 of the plate-shaped member 5B. Also, the length in the front-rear direction between the rear end portion of the plate engaging portion 55B and the rear edge of the second plate end portion 52 of the plate-shaped member 5A is denoted by the distance L52. The distance L23 denotes the length in the front-rear direction between the rear edge of the rear end portion 32A of the insertion portion 32 of the spout 3 and the rear edge of the second container end portion 22. The distance L52 is slightly longer than the distance L23 (L52>L23). A distance L53 denotes the length in the left-right direction between the right side of the third plate end portion 63 and the left side of the fourth plate end portion 64 of the plate-shaped member 5B. Also, the length in the left-right direction between the right side of the third plate end portion 53 and the left side of the fourth plate end portion 54 (refer to FIG. 2) of the plate-shaped member 5A is denoted by The distance L53. The distance L24 denotes the length in the left-right direction between the right side of the third container end portion 23 and the left side of the fourth container end portion 24 in the liquid container 2. The distance L53 is slightly longer than the distance L24 (L53>L24).

[Bag 9]

As shown in FIG. 1, the bag 9 is able to enclose the liquid container 2 and the plate-shaped members 5. The bag 9 may be formed by thermally welding portions, excluding the front side, of the peripheral end portions of two rectangular sheets of transparent film together, for example. The bag 9 includes an opening 9A that is thermally welded in a state in which the liquid container 2 and the plate-shaped members 5 are enclosed in the bag 9, on the front end portion of the bag 9. The length in the longitudinal direction of the bag 9 is longer than the distance L51 (refer to FIG. 5) of the plate-shaped members 5. The length in the lateral direction of the bag 9 is longer than the distance L53 (refer to FIG. 5) of the plate-shaped members 5.

[Manufacturing Method of Liquid Storage Unit 1A]

As shown in FIG. 2(B) to FIG. 2(D), the liquid container 2 is sandwiched from both sides in the up-down direction by the plate-shaped members 5A and 5B. At this time, the plate engaging portion 55B of the plate-shaped member 5A and the plate engaging portion 65B of the plate-shaped member 5B surround the insertion portion 32 of the spout 3. The lengths in the left-right direction of the plate engaging portion 55B and the plate engaging portion 65B of the spout 3 are the same, as described above. The plate engaging portion 55B engages from the upper side with the insertion portion 32 of the spout 3 of the liquid container 2, and the plate engaging portion 65B engages from the lower side with the insertion portion 32 of the spout 3 of the liquid container 2. Therefore, the liquid container 2 is positioned in the left-right direction with respect to the plate-shaped members 5 as a result of the plate engaging portions 55B and 65B engaging with the insertion portion 32. Also, the liquid container 2 is positioned in the front-rear direction with respect to the plate-shaped members 5 as a result of the rear end portion 32A of the insertion portion 32 of the spout 3 contacting the rear end portion of each of the plate engaging portions 55B and 65B from the front.

The first plate end portion 51 of the plate-shaped member 5A and the first plate end portion 61 of the plate-shaped member 5B sandwich a portion, excluding the connection portion 21A, of the first container end portion 21 of the liquid container 2 from both sides in the up-down direction in a state in which the liquid container 2 is positioned with respect to the plate-shaped member 5. Meanwhile, the insertion portion 32 of the spout 3 is welded to the connection portion 21A of the first container end portion 21, and the insertion portion 32 engages with the plate engaging portions 55B and 65B. The connection portion 21A is provided on the first container end portion 21, and is connected to the spout 3 and the storage portion 20. The length in the left-right direction of the plate engaging portions 55B and 65B is longer than the length in the left-right direction of the connection portion 21A. Therefore, the connection portion 21A is exposed via the plate engaging portions 55B and 65B. That is, the first plate end portions 51 and 61 do not sandwich the connection portion 21A from above and below (refer to FIG. 5). Note that the length in the left-right direction of the plate engaging portions 55B and 65B may be the same as the length in the left-right direction of the connection portion 21A. At this time, the first plate end portions 51 and 61 do not sandwich the connection portion 21A from above and below.

As shown in FIG. 3, the main body 31 and the second spout engaging portion 34 of the spout 3 are arranged on the lower side with respect to the main portion 55A of the plate-shaped member 5A, and on the upper side with respect to the main portion 65A of the plate-shaped member 5B. That is, the main body 31 and the second spout engaging portion 34 of the spout 3 are arranged in the space surrounded by the main portion 55A of the plate-shaped member 5A and the main portion 65A of the plate-shaped member 5B. Also, the leading end portion of the first spout engaging portion 33 extends lower than the lower end portion of the second spout engaging portion 34, is inserted from the upper side through the through-hole 66 in the plate-shaped member 5B, and is arranged on the lower side with respect to the main portion 65A of the plate-shaped member 5B. Therefore, the first plate end portions 51 and 61 do not sandwich the first spout engaging portion 33 from above and below.

As shown in FIG. 2(B) to FIG. 2(D), the second plate end portion 52 of the plate-shaped member 5A and the second plate end portion 62 of the plate-shaped member 5B sandwich the second container end portion 22 of the liquid container 2 from both sides in the up-down direction. The distance L52 denotes the length between the rear edge of the plate engaging portion 65B and the rear edge of the second plate end portion 62 of the plate-shaped member 5B (refer to FIG. 5). The distance L23 denotes the length between the rear edge of the rear end portion 32A of the spout 3 and the rear edge of the second container end portion 22 of the liquid container 2 (refer to FIG. 5). The distance L52 is slightly longer than the distance L23 (refer to FIG. 5). The relationship between the lengths of each of the plate-shaped member 5A and the liquid container 2 is also the same. Therefore, in a state in which the insertion portion 32 of the spout 3 of the liquid container 2 is engaged with the plate engaging portions 55B and 65B of the plate-shaped members 5, the rear end portion of the second container end portion 22 of the liquid container 2 is arranged in front of the rear end portions of the second plate end portions 52 and 62 that are the end portions at the rear of the plate-shaped members 5. That is, the second container end portion 22 of the liquid container 2 does not protrude to the rear with respect to the second plate end portions 52 and 62 of the plate-shaped members 5 (refer to FIG. 1 and FIG. 5).

The third plate end portion 53 of the plate-shaped member 5A and the third plate end portion 63 of the plate-shaped member 5B sandwich the third container end portion 23 of the liquid container 2 from both sides in the up-down direction. The fourth plate end portion 54 of the plate-shaped member 5A and the fourth plate end portion 64 of the plate-shaped member 5B sandwich the fourth container end portion 24 of the liquid container 2 from both sides in the up-down direction. The distance L53 denotes the length between the right side of the third plate end portion 63 and the left side of the fourth plate end portion 64 of the plate-shaped member 5B (refer to FIG. 5). The distance L24 denotes the length between the right side of the third container end portion 23 and the left side of the fourth container end portion 24 of the liquid container 2 (refer to FIG. 5). The distance L53 is slightly longer than the distance L24 (refer to FIG. 5). The relationship between the lengths of each of the plate-shaped member 5A and the liquid container 2 is also the same. Therefore, when the plate engaging portions 55B and 65B are engaged with the insertion portion 32 of the spout 3 of the liquid container 2, the right end portion of the third container end portion 23 of the liquid container 2 is arranged to the left of the right end portions of the third plate end portions 53 and 63 of the plate-shaped members 5. The left end portion of the fourth container end portion 24 of the liquid container 2 is arranged to the right of the left end portions of the fourth plate end portions 54 and 64 of the plate-shaped members 5. That is, the third container end portion 23 of the liquid container 2 does not protrude to the right with respect to the third plate end portions 53 and 63 of the plate-shaped members 5, and the fourth container end portion 24 of the liquid container 2 does not protrude to the left with respect to the fourth plate end portions 54 and 64 of the plate-shaped members 5. Also, the plate center portion 50 of the plate-shaped member 5A and the plate center portion 60 of the plate-shaped member 5B sandwich the storage portion 20 of the liquid container 2 from both sides in the up-down direction.

As shown in FIG. 1, the liquid container 2 and the plate-shaped members 5 are inserted from the rear end portion side into the opening 9A of the bag 9 in a state in which the plate-shaped members 5 are sandwiching the liquid container 2 from both sides in the up-down direction. After the bag 9 encloses the entirety of the liquid container 2 and the plate-shaped members 5, the manufacturer removes the air inside the bag 9 through the opening 9A. As shown in FIG. 3, the inside of the bag 9 consequently comes to be in a depressurized state, so the inside surface of the bag 9 contacts the plate-shaped members 5. The plate-shaped members 5A and 5B receive force from the bag 9 in a direction that brings the plate-shaped members 5A and 5B toward each other, such that the plate-shaped members 5A and 5B come into close contact with the liquid container 2. After the inside of the bag 9 has been depressurized, the opening 9A of the bag 9 is sealed by thermal welding. At this time, the bag 9 maintains the state in which the inside of the bag 9 is depressurized. With this, the manufacture of the liquid storage unit 1A is completed. Note that as shown in FIG. 1, in the liquid storage unit 1A, the bag 9 is transparent, so the liquid information 50A can be seen from the outside through the bag 9.

[First Cartridge 4]

Figure 6:
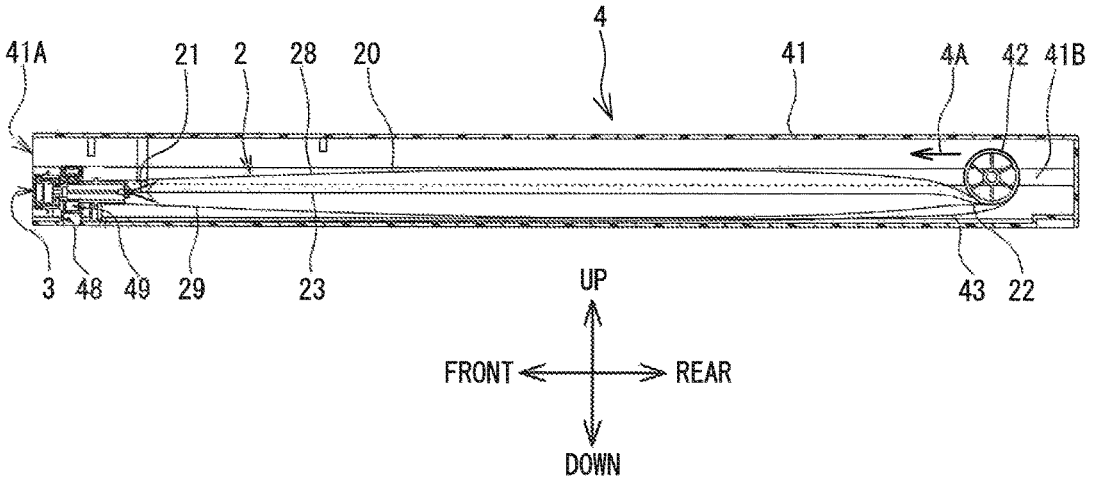
FIG. 6 is a view of a liquid container housed inside a first cartridge.

As shown in FIG. 6, the first cartridge 4 includes a case 41, a shaft portion 42, an elastic member 43, and the engaged portions 48 and 49. The case 41 has a rectangular appearance that is long in the front-rear direction, and is provided with an opening 41A in the front end portion. The shaft portion 42 has a cylindrical shape that extends in the left-right direction. A protruding portion (not shown in the drawings) is provided on an end portion in the left-right direction of the shaft portion 42 and protrudes toward the outside in the left-right direction from the end portion. The protruding portion is arranged on a recessed portion 41B provided on the side surface in the left-right direction on the inside of the case 41. The recessed portion 41B is recessed toward the outside in the left-right direction and extends in the front-rear direction. The elastic member 43 extends in the front-rear direction on the inside of a lower wall surface of the case 41. The front end portion of the elastic member 43 is fixed near the opening 41A of the case 41, and the rear end portion of the elastic member 43 is wound around the shaft portion 42. Restoring force in a direction that moves the shaft portion 42 that is positioned on the rear end portion side of the case 41 forward acts on the shaft portion 42 by the elastic member 43. The engaged portions 48 and 49 are each provided near the opening 41A.

[Mode of Use of the Liquid Container 2]

First, a user of the inkjet printer removes the liquid container 2 and the plate-shaped members 5 shown in FIG. 1 from the bag 9. Next, the user removes the liquid container 2 from the plate-shaped members 5. Then, the user places the liquid container 2 on the upper side of the elastic member 43 of the first cartridge 4, as shown in FIG. 6. At this time, the shaft portion 42 and the elastic member 43 sandwich the second container end portion 22 of the liquid container 2. The first spout engaging portion 33 (refer to FIG. 3) engages with the engaged portion 48, and the second spout engaging portion 34 (refer to FIG. 3) engages with the engaged portion 49. Therefore, the spout 3 fixes the arrangement position near the opening 41A. Next, the user installs the first cartridge 4 in a state in which the liquid container 2 is attached to the first cartridge 4, to the inkjet printer (not shown in the drawings). When the first cartridge 4 is installed in the inkjet printer, a lead-out needle (not shown in the drawings) of the inkjet printer connects to the spout 3. The lead-out needle that is connected to the spout 3 passes through the rubber plug 36A (refer to FIG. 3). Therefore, the ink inside the storage portion 20 is supplied to the inkjet printer via the lead-out needle in a state in which the inkjet printer and the spout 3 are connected.

The remaining amount of ink in the storage portion 20 of the liquid container 2 decreases as the ink in the storage portion 20 is supplied to the inkjet printer. At this time, the elastic member 43 urges the shaft portion 42 of the first cartridge 4 forward by the restoring force of the elastic member 43. Therefore, as the remaining amount of ink in the storage portion 20 decreases, the shaft portion 42 moves forward while sequentially winding up the liquid container 2 from the second container end portion 22 side (arrow 4A). As the shaft portion 42 moves, the ink in the storage portion 20 moves toward the spout 3, so the storage portion 20 supplies ink to the inkjet printer without waste.

[Main Operation and Effects of the Present Embodiment]

In the liquid storage unit 1A, the plate-shaped members 5 sandwich the container end portions 2B (the first container end portion 21 to the fourth container end portion 24) of the liquid container 2 from both sides in the up-down direction. When the bag 9 is depressurized in a state in which the plate-shaped members 5 and the liquid container 2 are enclosed inside the bag 9, the inside surface of the bag 9 contacts the plate-shaped members 5, and the plate-shaped members 5 come into close contact with the container end portions 2B of the liquid container 2. Therefore, in the liquid storage unit 1A, the container end portions 2B of the liquid container 2 can be fixed by the plate-shaped members 5, so the container end portions 2B can be inhibited from bending. Note that when the container end portions 2B of the liquid container 2 are bent such that a bending tendency is created, the bending tendency may inhibit the winding of the liquid container 2 by the shaft portion 42 inside the first cartridge 4. At this time, movement of the ink toward the spout 3 is inhibited, so ink may remain in the storage portion 20 of the liquid container 2. However, with the liquid storage unit 1A, such a bending tendency can be inhibited from being created in the container end portions 2B of the liquid container 2 by the plate-shaped members 5, so ink can be supplied without waste to the inkjet printer.

When a bending tendency is created in the second container end portion 22, there are case in which the movement of the shaft portion 42 is inhibited as the liquid container 2 is initially wound by the shaft portion 42 of the first cartridge 4. At this time, there is a possibility that the shaft portion 42 will not wind the storage portion 20 that stores the ink, and the bending tendency of the second container end portion 22 will inhibit the ink from being suitably supplied to the inkjet printer. Also, the shaft portion 42 will not wind the storage portion 20 as the second container end portion 22 is initially wound by the shaft portion 42 of the first cartridge 4. Therefore, ink will not remain in the portion of the liquid container 2 that is first wound. Moreover, the shaft portion 42 winds the liquid container 2 from the second container end portion 22 that does not store ink toward the storage portion 20 that stores ink. Therefore, the ink in the storage portion 20 more easily moves to the spout 3 compared to when winding starts from the storage portion 20. Because ink tends not to remain in the storage portion 20, it is very important to suitably wind the second container end portion 22 with the shaft portion 42. Meanwhile, in the liquid storage unit 1A, the second plate end portions 52 and 62 of the plate-shaped members 5 sandwich the second container end portion 22 of the liquid container 2 from both sides in the up-down direction. Therefore, in the liquid storage unit 1A, the second container end portion 22 of the liquid container 2 can be fixed by the plate-shaped members 5, so the second container end portion 22 can be inhibited from bending and thus having a bending tendency. Therefore, the shaft portion 42 of the first cartridge 4 can suitably wind the second container end portion 22, so the likelihood of ink remaining in the storage portion 20 of the liquid container 2 can be reduced.

The length in the front-rear direction of the liquid container 2 is relatively long compared to the length in the left-right direction. In the container end portions 2B, A recess is more easily formed, in a state in which ink is stored in the storage portion 20, in the third container end portion 23 and the fourth container end portion 24 that extend along the front-rear direction, than in the first container end portion 21 and the second container end portion 22 that extend along the left-right direction. Therefore, the third container end portion 23 and the fourth container end portion 24 will bend more easily than the first container end portion 21 and the second container end portion 22. Also, because the sheets 28 and 29 of the portion of the storage portion 20 that stores ink are spaced apart in the up-down direction, the portions of the third container end portion 23 and the fourth container end portion 24 that are on the rear side close to the second container end portion 22 will bend particularly easily. However, in the liquid storage unit 1A, the third plate end portions 53 and 63 of the plate-shaped members 5 sandwich the third container end portion 23 of the liquid container 2 from both sides in the up-down direction, and the fourth plate end portions 54 and 64 of the plate-shaped members 5 sandwich the fourth container end portion 24 from both sides in the up-down direction. Therefore, in the liquid storage unit 1A, the third container end portion 23 and the fourth container end portion 24 of the liquid container 2 can be fixed by the plate-shaped members 5, so the third container end portion 23 and the fourth container end portion 24 can be inhibited from bending and thus having a bending tendency.

When the shape of the storage portion 20 of the liquid container 2 changes, the physical properties of the ink may change in accordance with the movement of the ink stored in the storage portion 20. As a specific example of the change in the physical properties of the ink, there is agglomeration of the dispersed substances (pigment, resin component, etc.) dispersed in the ink. However, in the liquid storage unit 1A, the plate center portions 50 and 60 of the plate-shaped members 5 sandwich the storage portion 20 of the liquid container 2 from both sides in the up-down direction. When an impact is applied from the outside, the liquid container 2 can reduce the force applied to the storage portion 20 with the plate center portions 50 and 60. At this time, the plate-shaped members 5 of the liquid storage unit 1A can maintain the shape of the storage portion 20 of the liquid container 2, so the shape of the storage portion 20 can be inhibited from changing and consequently the ink stored inside of the storage portion 20 can be inhibited from moving. Moreover, force toward the outside acts on the ink in response to depressurizing the inside of the bag 9. Therefore, in the liquid storage unit 1A, the ink inside the storage portion 20 can be inhibited from moving, so the likelihood that the physical properties will change in response to movement of the ink can be reduced. Note that the change in the physical properties of the ink due to movement of the ink tends to occur particularly with cyan ink. Therefore, in the liquid storage unit 1A that includes the liquid container 2 in which cyan ink in particular is stored in the storage portion 20, the likelihood that the physical properties of the cyan ink will change can be suitably reduced.

Moreover, when the liquid container 2 is sandwiched in the up-down direction by the plate-shaped members 5 lacking the plate center portions 50 and 60, i.e., by the plate-shaped members 5 having through-holes formed in the center portions, the edge portions of the through-holes in the plate-shaped members 5 contact the storage portion 20 of the liquid container 2. At this time, the storage portion 20 may be rubbed and be damaged as a result of receiving force from the edge portions of the through-holes. However, the plate-shaped members 5 have the plate center portion 50 at a portion surrounded by the first plate end portion 51 to the fourth plate end portion 54, and have the plate center portion 60 at a portion surrounded by the first plate end portion 61 to the fourth plate end portion 64. At this time, through-holes are not formed in the portions surrounded by the peripheral edge portions of the plate-shaped members 5. Therefore, in the liquid storage unit 1A, the edge portions of the through-holes in the plate-shaped members 5 can be prevented from contacting and rubbing against the storage portion 20 of the liquid container 2.

The first plate end portions 51 and 61 of the plate-shaped members 5 sandwich the first container end portion 21 of the liquid container 2 from both sides in the up-down direction. At this time, in the liquid storage unit 1A, the first container end portion 21 of the liquid container 2 can be fixed by the plate-shaped members 5. Therefore, the liquid container 2 can inhibit the first container end portion 21 from bending and thus having a bending tendency.

In the first container end portion 21, the connection portion 21A is welded to the insertion portion 32 of the spout 3 and is exposed via the plate engaging portions 55B and 65B. The first plate end portions 51 and 61 do not sandwich the connection portion 21A from above and below. At this time, in the liquid storage unit 1A, the likelihood that the insertion portion 32 of the spout 3 will be damaged by the plate-shaped members 5 contacting the connection portion 21A can be reduced.

In the liquid storage unit 1A, the liquid container 2 is positioned with respect to the plate-shaped members 5 by the insertion portion 32 of the spout 3 of the liquid container 2 engaging with the plate engaging portions 55B and 65B of the plate-shaped members 5. The rear end portion of the second container end portion 22 of the liquid container 2 is arranged in front of the rear end portions of the second plate end portions 52 and 62 of the plate-shaped members 5, in a state in which the liquid container 2 is positioned with respect to the plate-shaped members 5. At this time, in the liquid storage unit 1A, the likelihood that the second container end portion 22 of the liquid container 2 will protrude to the rear with respect to the second plate end portions 52 and 62 of the plate-shaped members 5 can be reduced. Therefore, in the liquid storage unit 1A, the second container end portion 22 of the liquid container 2 can be inhibited from bending and thus having a bending tendency along the entire region of the second container end portion 22.

In the liquid storage unit 1A, the liquid container 2 includes the connection portion 21A that is provided on the first container end portions 21 and 81, and that is connected to the spout 3 and the storage portion 20. The plate-shaped members 5 include the plate engaging portion 55B and 65B that engage with the spout 3. The length in the left-right direction of the plate engaging portions 55B and 65B is the same or longer than the length in the left-right direction of the connection portion 21A. At this time, in the liquid storage unit 1A, the likelihood that the connection portion 21A will be damaged by the plate-shaped members 5 can be reduced.

In the liquid storage unit 1A, the plate engaging portions 55B and 65B are recessed portions that are recessed toward the rear in the front-rear direction from the end portion on the front side in the front-rear direction of the plate-shaped members 5. At this time, in the liquid storage unit 1A, the likelihood that the connection portion 21A will be damaged can be reduced because the plate engaging portions 55B and 65B are recessed portions.

In the liquid storage unit 1A, the plate-shaped members 5 are provided with the plate engaging portions 55B and 65B that engage with the spout 3. The second container end portions 22 and 82 of the liquid container 2 are positioned farther forward in the front-rear direction than the end portion on the rearward side in the front-rear direction of the plate-shaped members 5, while the spout 3 is in a state engaged with the plate engaging portions 55B and 65B. At this time, in the liquid storage unit 1A, the second container end portions 22 and 82 are positioned farther forward in the front-rear direction than the end portion on the rearward side in the front-rear direction of the plate-shaped members 5, so the likelihood that the second container end portions 22 and 82 will protrude from the plate-shaped members 5 can be reduced.

The first spout engaging portion 33 of the spout 3 is inserted through the through-hole 66 in the plate-shaped member 5B from the upper side. Therefore, the first plate end portions 51 and 61 do not sandwich the first spout engaging portion 33 from above and below. Therefore, in the liquid storage unit 1A, the likelihood that the first spout engaging portion 33 will be damaged by the first plate end portions 51 and 61 sandwiching the first spout engaging portion 33 from above and below can be reduced. The first spout engaging portion 33 and the second spout engaging portion 34 have different shapes. Therefore, it is possible to prevent the first spout engaging portion 33 and the second spout engaging portion 34 from being fixed in position in the wrong orientation.

The liquid storage unit 1A includes the first and second spout engaging portions 33 and 34 that are provided on the spout 3 and fix the position of the spout 3. The plate-shaped members 5 include a recessed portion that is provided at an end portion on the front side in the front-rear direction and that is recessed toward the rear end side in the front-rear direction. The length in the left-right direction of the recessed portion is the same or longer than the length of the front end portion including the spout 3 and the first and second spout engaging portions 33 and 34 in the left-right direction. Therefore, the likelihood that the first and second spout engaging portions 33 and 34 will be damaged by the plate-shaped members 5 can be reduced.

In the liquid storage unit 1A, the first spout engaging portion 33 extends downward in the up-down direction from the end portion on the right side in the left-right direction of the spout 3. The second spout engaging portion 34 extends downward in the up-down direction from the end portion on the left side in the left-right direction of the spout 3, and extends upward in the up-down direction and to the left side in the left-right direction from the end portion on the lower side in the up-down direction. Therefore, because the first spout engaging portion 33 and the second spout engaging portion 34 have different shapes, the first spout engaging portion 33 and the second spout engaging portion 34 can be prevented from being fixed in position in the wrong orientation.

The plate engaging portion 55B and 65B of the plate-shaped members 5 do not cover the connection portion 21A of the first container end portion 21 of the liquid container 2. Therefore, the connection portion 21A is exposed via the plate engaging portions 55B and 65B, and thus can be seen from the outside. Moreover, the sheets 2A that form the liquid container 2 are transparent, and the insertion portion 32 of the spout 3 is transparent. Therefore, outside light falls on the ink that flows through the insertion portion 32 from the storage portion 20, via the connection portion 21A and the insertion portion 32. The outside light is reflected by the ink and is emitted outside via the connection portion 21A and the insertion portion 32. Therefore, the ink can be seen from the outside. The user can see the color and state and the like of the ink stored in the storage portion 20 by visually confirming the connection portion 21A from the outside via the plate engaging portions 55B and 65B. That is, the plate engaging portions 55B and 65B serve as windows for outside light to fall on the ink.

The left edge and the right edge of the each of the second plate end portions 52 and 62 of the plate-shaped members 5 have a tapered shape in which the length in the left-right direction decreases toward the rear. At this time, in the liquid storage unit 1A, the plate-shaped members 5 can be inhibited from catching on the opening 9A of the bag 9 when the plate-shaped members 5 are inserted into the bag 9 from the second plate end portion 52 and 62 side. Therefore, the manufacturer of the liquid storage unit 1A can smoothly insert the plate-shaped members 5 into the bag 9.

With the liquid storage unit 1A, cardboard which is material that is more environmentally friendly than composite resin that is typically used as the plate material, can be used for the plate-shaped members 5. Also, the plate-shaped members 5 each have the wavy-shaped core 59 in which the mountain portions 59A and the valley portions 59B that extend in the left-right direction are alternately arranged in the front-rear direction. At this time, the strength of the plate-shaped members 5 with respect to bending in the left-right direction is greater than the strength with respect to bending in the front-rear direction. Therefore, the plate-shaped members 5 will not easily bend in the left-right direction. Therefore, with the liquid storage unit 1A, the ability of the plate-shaped members 5 to follow the sheets 2A of the liquid container 2 becomes particularly high in the longitudinal direction of the liquid container 2. That is, in the liquid storage unit 1A, the plate-shaped members 5 can closely contact the sheets 2A along the entire region in the longitudinal direction of the liquid container 2. Therefore, in the liquid storage unit 1A, the liquid container 2 can be inhibited from bending and thus having a bending tendency along the entire region of the liquid container 2 in the longitudinal direction.

The bag 9 used in the liquid storage unit 1A is transparent. Therefore, the liquid information 50A and 60A printed on the plate-shaped members 5 can be seen from outside the bag 9. At this time, the user of the liquid storage unit 1A can easily confirm the information related to the ink stored in the storage portion 20 of the liquid container 2.

[First Modified Example]

A liquid storage unit 1B according to a first modified example of the present disclosure will be described with reference to FIG. 7 and FIG. 8. The liquid storage unit 1B differs from the liquid storage unit 1A in that the liquid storage unit 1B has a plate-shaped member 7 instead of the plate-shaped members 5 of the liquid storage unit 1A. The liquid container 2 and the bag 9 are the same as in the liquid storage unit 1A, so descriptions of the liquid container 2 and the bag 9 will be omitted below.

The plate-shaped member 7 sandwiches the liquid container 2 from both sides in the up-down direction in a state in which the plate-shaped member 7 is bent at connecting portions 7A and 7B that will be described later. The state of the plate-shaped member 7 in which the plate-shaped member 7 is bent at the connecting portions 7A and 7B will be referred to as a first state. FIG. 7 shows the liquid storage unit 1B that includes the plate-shaped member 7 in the first state. Hereinafter, when describing the plate-shaped member 7 in the first state, the side inclined upward and to the left, the side inclined downward and to the right, the side inclined downward and to the left, the side inclined upward and to the right, the upper side and the lower side in FIG. 7 will be defined as the left side, the right side, the front side, the rear side, the upper side, and the lower side of the plate-shaped member 7.

Figure 8:
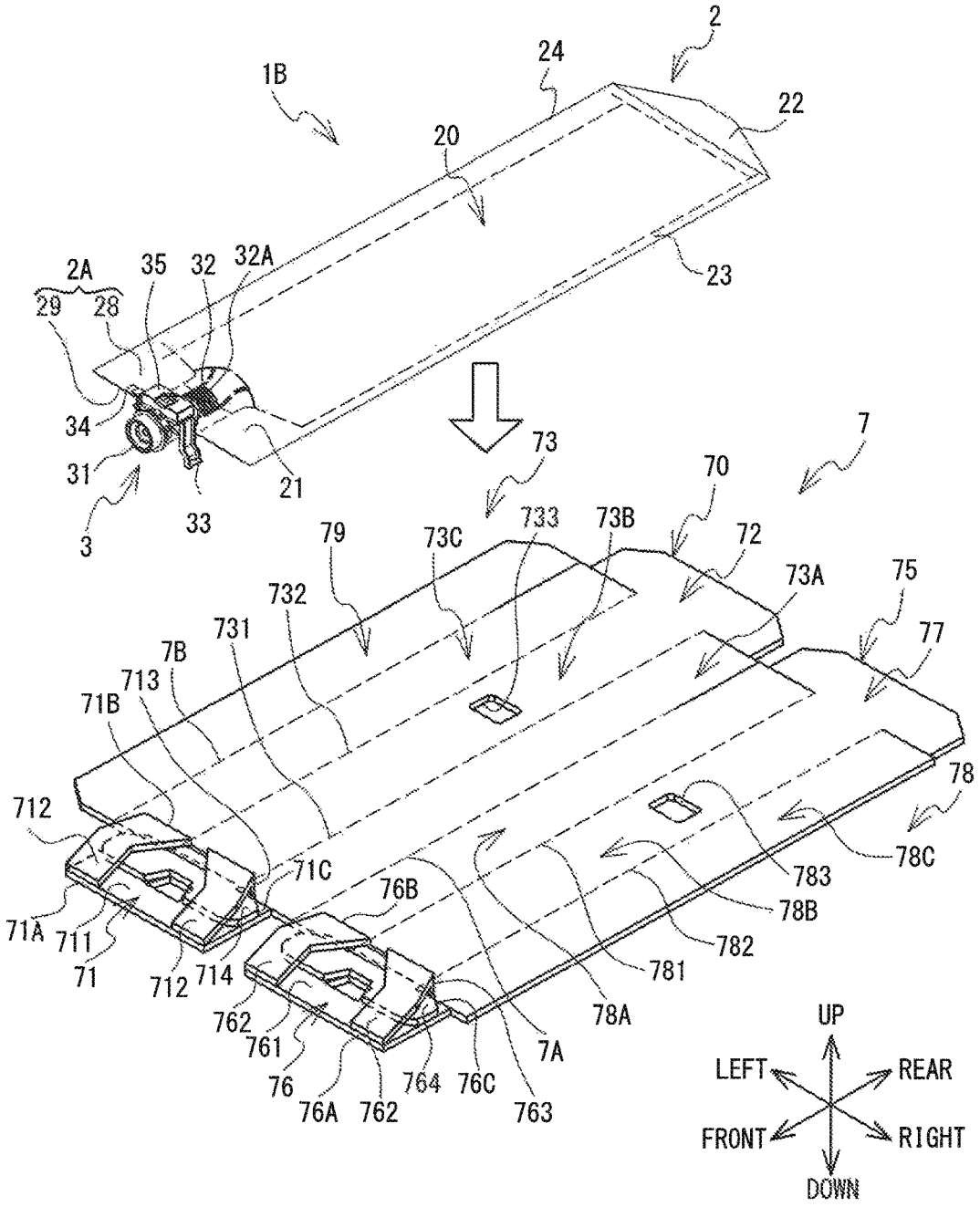
FIG. 8 is an exploded perspective view of the liquid storage unit excluding a bag.

FIG. 8 shows the liquid container 2 and the plate-shaped member 7 in a state in which the plate-shaped member 7 is not bent at the connecting portions 7A and 7B. The state of the plate-shaped member 7 in which the plate-shaped member 7 is not bent at the connecting portions 7A and 7B will be referred to as a second state. Hereinafter, when describing the plate-shaped member 7 in the second state, the side inclined upward and to the left, the side inclined downward and to the right, the side inclined downward and to the left, the side inclined upward and to the right, the upper side and the lower side in FIG. 8 will be defined as the left side, the right side, the front side, the rear side, the upper side, and the lower side of the plate-shaped member 7.

The plate-shaped member 7 in the second state will be described with reference to FIG. 8. The plate-shaped member 7 is made of cardboard and has a first plate-shaped portion 70, a second plate-shaped portion 75, and a third plate-shaped portion 79. The first plate-shaped portion 70 is arranged to the left of the second plate-shaped portion 75, and the third plate-shaped portion 79 is arranged to the left of the first plate-shaped portion 70. The first plate-shaped portion 70 and the second plate-shaped portion 75 are connected by the connecting portion 7A that will be described later. The first plate-shaped portion 70 and the third plate-shaped portion 79 are connected by the connecting portion 7B that will be described later. When the plate-shaped member 7 is bent at the connecting portion 7A, the first plate-shaped portion 70 and the second plate-shaped portion 75 sandwich the liquid container 2 from both sides in the up-down direction (refer to FIG. 7).

The first plate-shaped portion 70 has a rectangular shape. The longitudinal direction of the first plate-shaped portion 70 extends in the front-rear direction, and the lateral direction of the first plate-shaped portion 70 extends in the left-right direction. The first plate-shaped portion 70 includes a first plate end portion 71, a second plate end portion 72, and a plate center portion 73. Notches 731 and 732 are provided in the plate center portion 73, which facilitate bending. The notches 731 and 732 extend in the front-rear direction and divide the plate center portion 73 into three equal parts in the left-right direction. The notch 731 is arranged to the right with respect to the notch 732. The plate center portion 73 bends at the notches 731 and 732 such that the upper surfaces of the plate center portion 73 come close to each other. The portions of the plate center portion 73 that is divided equally into three by the notches 731 and 732 will be referred to as a third plate end portion 73A, a center portion 73B, and a fourth plate end portion 73C, respectively, in order from the right side. A through-hole 733 that has a rectangular shape is provided in the center portion 73B.

The first plate end portion 71 is arranged in front of the plate center portion 73. The rear end portion of the first plate end portion 71 is connected to the front end portion of the center portion 73B. Notches 71A to 71C are provided in the first plate end portion 71, which facilitate bending. The notches 71A to 71C extend in the left-right direction and divide the first plate end portion 71 into four in the front-rear direction. The upper surfaces of the first plate end portion 71 bend so as to come close to each other due to the notches 71A to 71C. FIG. 8 shows a state in which the first plate end portion 71 bent at the notches 71A to 71C. The four portions into which the first plate end portion 71 is divided by the notches 71A to 71C will be referred to as a first portion 711, two second portions 712, a third portion 713, and a fourth portion 714, respectively, in order from the plate center portion 73 side. The two second portions 712 are provided one in each of two locations separated in the left-right direction. When the first plate end portion 71 is bent at the notches 71A to 71C, the first portion 711 extends toward the front from the front end portion of the plate center portion 73. The two second portions 712 extend upward and to the rear at an angle from the front end portion of the first portion 711. The third portion 713 extends downward from the rear end portions of the two second portions 712. The fourth portion 714 extends from the lower end of the third portion 713 toward the front along the upper surface of the first portion 711.

The second plate end portion 72 is arranged to the rear of the plate center portion 73. The front edge of the second plate end portion 72 is connected to the rear edge of the center portion 73B. The left edge and the right edge of the second plate end portion 72 have a tapered shape. Therefore, the length in the left-right direction of the second plate end portion 72 becomes shorter toward the rear.

The second plate-shaped portion 75 has the same shape as the first plate-shaped portion 70. A first plate end portion 76, a second plate end portion 77, and a plate center portion 78 of the second plate-shaped portion 75 correspond to the first plate end portion 71, the second plate end portion 72, and the plate center portion 73 of the first plate-shaped portion 70. Notches 781 and 782 in the plate center portion 78 correspond to the notches 732 and 731 in the plate center portion 73. A third plate end portion 78A, a center portion 78B, and a fourth plate end portion 78C of the plate center portion 78 correspond to the fourth plate end portion 73C, the center portion 73B, and the third plate end portion 73A of the plate center portion 73. A through-hole 783 in the center portion 78B corresponds to the through-hole 733 in the center portion 73B. Notches 76A, 76B, and 76C in the first plate end portion 76 correspond to the notches 71A, 71B, and 71C in the first plate end portion 71. A first portion 761, two second portions 762, a third portion 763, and a fourth portion 764 of the first plate end portion 76 correspond to the first portion 711, the two second portions 712, the third portion 713, and the fourth portion 714 of the first plate end portion 71.

The connecting portion 7A connects the right edge of the third plate end portion 73A of the first plate-shaped portion 70 with the left edge of the third plate end portion 78A of the second plate-shaped portion 75 and facilitates bending. As shown in FIG. 7, the first plate end portion 71 of the first plate-shaped portion 70 and the first plate end portion 76 of the second plate-shaped portion 75 face each other in the up-down direction when the plate-shaped member 7 is in the first state. The second plate end portion 72 of the first plate-shaped portion 70 and the second plate end portion 77 of the second plate-shaped portion 75 face each other in the up-down direction. The third plate end portion 73A (refer to FIG. 8) of the first plate-shaped portion 70 and the third plate end portion 78A of the second plate-shaped portion 75 face each other in the up-down direction. The center portion 73B (refer to FIG. 8) of the first plate-shaped portion 70 and the center portion 78B of the second plate-shaped portion 75 face each other in the up-down direction. The fourth plate end portion 73C (refer to FIG. 8) of the first plate-shaped portion 70 and the fourth plate end portion 78C of the second plate-shaped portion 75 face each other in the up-down direction.

As shown in FIG. 8, the third plate-shaped portion 79 has a rectangular shape. The longitudinal direction of the third plate-shaped portion 79 extends in the front-rear direction, and the lateral direction of the third plate-shaped portion 79 extends in the left-right direction. The connecting portion 7B connects the right edge of the third plate-shaped portion 79 with the left edge of the fourth plate end portion 73C of the first plate-shaped portion 70 and facilitates bending. As shown in FIG. 7, when the plate-shaped member 7 is bent at the connecting portions 7A and 7B, the third plate-shaped portion 79 is arranged overlapping on the upper side with respect to the fourth plate end portion 78C of the second plate-shaped portion 75.

As shown in FIG. 8, when the liquid storage unit 1B is manufactured, the liquid container 2 is placed on the upper side of the plate-shaped member 7 in the second state. Next, the plate-shaped member 7 is bent in the left-right direction at the connecting portion 7A in a state in which the first plate end portion 71 is bent at the notches 71A to 71C and the first plate end portion 76 is bent at the notches 76A to 76C. The first plate-shaped portion 70 and the second plate-shaped portion 75 sandwich the liquid container 2 from both sides in the up-down direction. At this time, the third portion 713 of the first plate end portion 71 of the first plate-shaped portion 70, and the third portion 763 of the first plate end portion 76 of the second plate-shaped portion 75 each contact the front portion of the main body 31 of the spout 3 of the liquid container 2 from the rear side. Therefore, the liquid container 2 is positioned in the front-rear direction with respect to the plate-shaped member 7. Also, the two second portions 712 of the first plate end portion 71 of the first plate-shaped portion 70, and the two second portions 762 of the first plate end portion 76 of the second plate-shaped portion 75 each contact the front portion of the main body 31 of the spout 3 of the liquid container 2 from both the left and right sides. Therefore, the liquid container 2 is positioned in the left-right direction with respect to the plate-shaped member 7.

Figure 7:
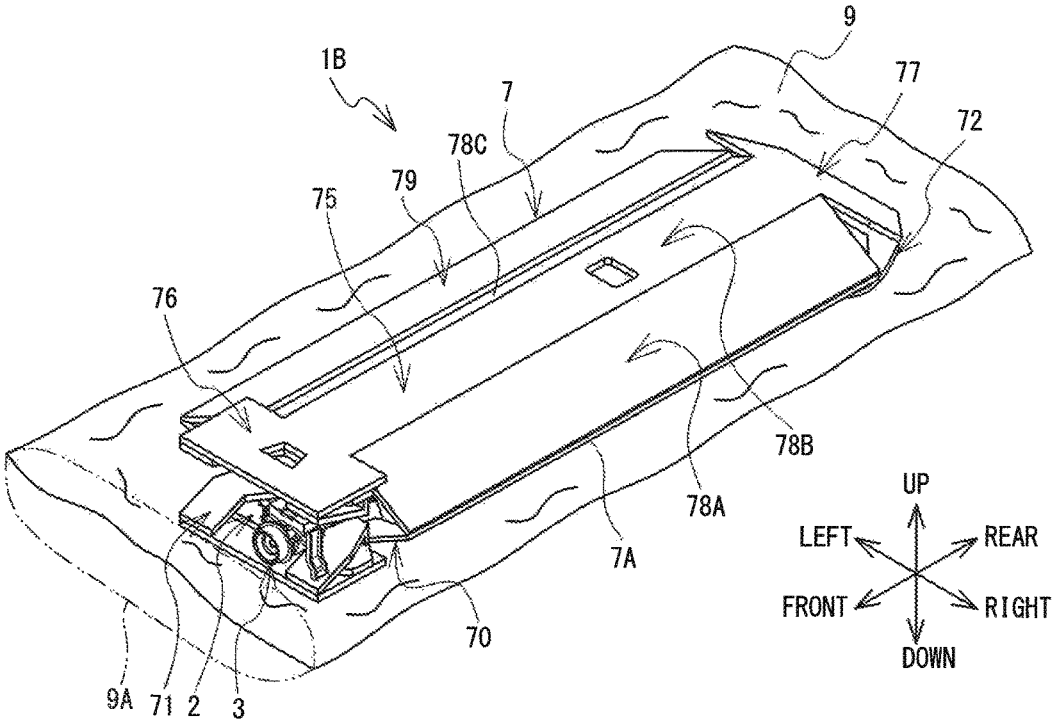
FIG. 7 is a perspective view of a liquid storage unit.

As shown in FIG. 7, in a state in which the liquid container 2 is positioned with respect to the plate-shaped member 7, the first plate end portion 71 of the first plate-shaped portion 70 and the first plate end portion 76 of the second plate-shaped portion 75 sandwich the first container end portion 21 (refer to FIG. 8) of the liquid container 2 from both sides in the up-down direction. The second plate end portion 72 of the first plate-shaped portion 70 and the second plate end portion 77 of the second plate-shaped portion 75 sandwich the second container end portion 22 (refer to FIG. 8) of the liquid container 2 from both sides in the up-down direction. The second container end portion 22 of the liquid container 2 does not protrude to the rear with respect to the second plate end portions 72 and 77 of the plate-shaped member 7. The third plate end portion 73A (refer to FIG. 8) of the first plate-shaped portion 70 and the third plate end portion 78A of the second plate-shaped portion 75 sandwich the third container end portion 23 (refer to FIG. 8) of the liquid container 2 from both sides in the up-down direction. The fourth plate end portion 73C (refer to FIG. 8) of the first plate-shaped portion 70 and the fourth plate end portion 78C of the second plate-shaped portion 75 sandwich the fourth container end portion 24 (refer to FIG. 8) of the liquid container 2 from both sides in the up-down direction. The center portion 73B (refer to FIG. 8) of the first plate-shaped portion 70 and the center portion 78B of the second plate-shaped portion 75 sandwich the storage portion 20 (refer to FIG. 8) of the liquid container 2 from both sides in the up-down direction. Finally, the plate-shaped member 7 is put in the first state by the connecting portion 7B bending. The upper surface (refer to FIG. 8) of the third plate-shaped portion 79 overlaps with the lower surface (refer to FIG. 8) of the fourth plate end portion 78C of the second plate-shaped portion 75 in a state in which the plate-shaped member 7 is in the first state (refer to FIG. 7).

Next, the liquid container 2 and the plate-shaped member 7 in the first state are inserted from the rear end portion side into the opening 9A of the bag 9 in a state in which the plate-shaped member 7 is sandwiching the liquid container 2. After the entirety of the liquid container 2 and the plate-shaped member 7 are enclosed in the bag 9, the manufacturer removes the air inside the bag 9 through the opening 9A. The inside of the bag 9 consequently comes to be in a depressurized state, so the inside surface of the bag 9 contacts the plate-shaped member 7. The third plate end portions 73A (refer to FIG. 8) and 78A of the plate-shaped member 7 closely contact the third container end portion 23 (refer to FIG. 8) of the liquid container 2 from both sides in the up-down direction. The fourth plate end portions 73C (refer to FIG. 8) and 78C of the plate-shaped member 7 closely contact the fourth container end portion 24 (refer to FIG. 8) of the liquid container 2 from both sides in the up-down direction. The center portions 73B (refer to FIG. 8) and 78B of the plate-shaped member 7 closely contact the storage portion 20 (refer to FIG. 8) of the liquid container 2 from both sides in the up-down direction. After the inside of the bag 9 has been depressurized, the opening 9A of the bag 9 is sealed by thermal welding. Therefore, the bag 9 maintains the state in which the inside of the bag 9 is depressurized. With this, the manufacture of the liquid storage unit 1B is completed.

[Operation and Effects of the First Modified Example]

When the plate-shaped member 7 in the second state becomes in the first state bent at the connecting portions 7A and 7B, the connecting portion 7A is arranged on the right edge of each of the first plate-shaped portion 70 and the second plate-shaped portion 75. Meanwhile, the plate-shaped member 7 sandwiches the liquid container 2 from both sides in the up-down direction by the portion of each of the first plate-shaped portion 70 and the second plate-shaped portion 75 that is to the left of the connecting portion 7A in the left-right direction. That is, the connecting portion 7A connects the right end portion of the first plate-shaped portion 70 with the left end portion of the second plate-shaped portion 75 at an opposite side in the left-right direction, of the first plate-shaped portion 70 and the second plate-shaped portion 75, with respect to the side of the liquid container 2 that is sandwiched. At this time, in the liquid storage unit 1B, the third container end portion 23 of the liquid container 2 can be inhibited from protruding to the right with respect to the first plate-shaped portion 70 and the second plate-shaped portion 75 by the connecting portion 7A. Therefore, in the liquid storage unit 1B, the third container end portion 23 of the liquid container 2 can be inhibited from bending and thus having a bending tendency along the entire region of the third container end portion 23. Also, in the liquid storage unit 1B, the fourth container end portion 24 of the liquid container 2 can be inhibited from protruding to the left with respect to the first plate-shaped portion 70 and the third plate-shaped portion 79 by the connecting portion 7B.

[Second Modified Example]

A liquid storage unit 1C according to a second modified embodiment of the present disclosure will be described with reference to FIG. 9 and FIG. 10. In the liquid storage unit 1C, the through-holes 55 and 65 in the plate-shaped members 5 are provided in positions offset to the right with respect to the center in the left-right direction of the first plate end portions 51 and 61. Also, the liquid storage unit 1C includes a liquid container 8 instead of the liquid container 2 (refer to FIG. 2). The lower surface of the liquid container 8 is fixed by a plate-shaped member 8C (refer to FIG. 10). The liquid container 8 and the plate-shaped member 8C are mounted to a second cartridge (not shown in the drawing) that is different from the first cartridge 4 (refer to FIG. 6). The second cartridge includes a rectangular case that is long in the front-rear direction, but does not include members corresponding to the shaft portion 42, the elastic member 43, and the engaged portions 48 and 49 of the first cartridge 4 (refer to FIG. 6). The second cartridge is installed in the inkjet printer (not shown in the drawings) in a state in which the liquid container 8 and the plate-shaped member 8C are mounted to the second cartridge. When the second cartridge is installed in the inkjet printer, the liquid container 8 supplies ink stored in a storage portion 80 to the inkjet printer.

Figure 10:
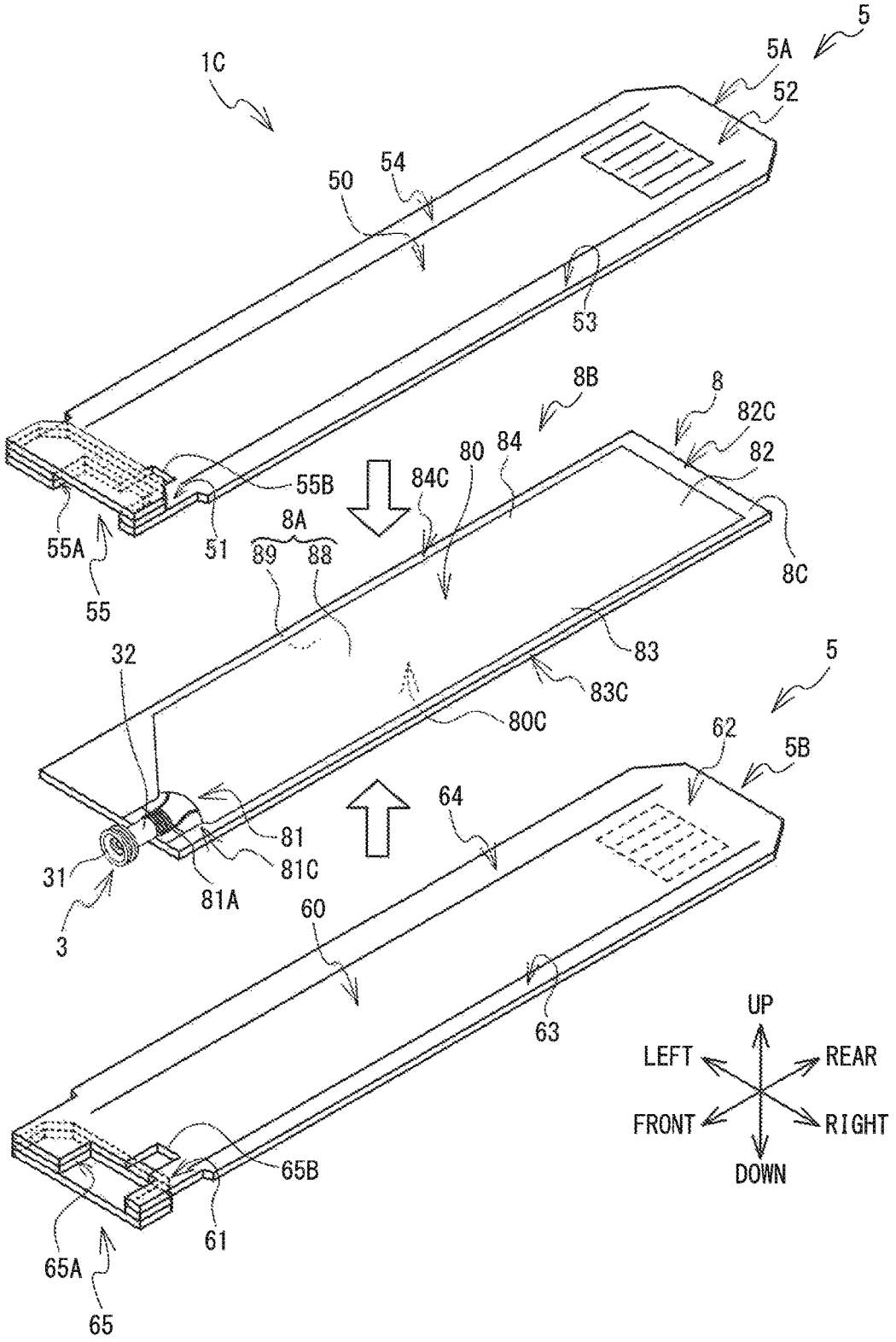
FIG. 10 is an exploded perspective view of the liquid storage unit excluding a bag.

As shown in FIG. 10, the liquid container 8 has flexible rectangular-shaped resin sheets 88 and 89. The liquid container 8 is formed by thermal welding. Peripheral edge portions of the sheets 88 and 89 are welded together by thermal welding in a state in which respective one surfaces of the sheets 88, and 89 face each other in the up-down direction. The sheets 88 and 89 will be collectively referred to as sheets 8A. The sheets 88 and 89 correspond to the sheets 28 and 29 (refer to FIG. 2) of the liquid container 2 (refer to FIG. 2). A first container end portion 81, a second container end portion 82, a third container end portion 83, a fourth container end portion 84, and a container end portion 8B, which have been thermally welded, of the sheet 8A correspond to the first container end portion 21, the second container end portion 22, the third container end portion 23, the fourth container end portion 24, and the container end portion 2B (refer to FIG. 2), respectively, of the liquid container 2. The storage portion 80 surrounded by the container end portion 8B corresponds to the storage portion 20 (refer to FIG. 2) of the liquid container 2. The spout 3 is provided on the first container end portion 81 of the sheet 8A and is fixed at a position offset to the right with respect to the center in the left-right direction. The spout 3 includes the main body 31 and the insertion portion 32, but does not include the first spout engaging portion 33, the second spout engaging portion 34, or the holder 35 of the liquid container 2 (refer to FIG. 2). Of the first container end portion 81, the portion that is welded to the insertion portion 32 of the spout 3 will be referred to as a connection portion 81A.

The plate-shaped member 8C has a rectangular shape and is connected to the lower surface of the sheet 89 of the liquid container 8. The length in the longitudinal direction of the plate-shaped member 8C is slightly longer than the length in the longitudinal direction of the liquid container 8. The length in the lateral direction of the plate-shaped member 8C is slightly longer than the length in the lateral direction of the liquid container 8. The plate-shaped member 8C covers the entire sheet 8A of the liquid container 8 from the lower side. The rigidity of the plate-shaped member 8C is greater than the rigidity of the sheets 2A. The plate-shaped member 8C is formed by a paper board, a resin plate, a metal plate, or cardboard, etc., for example. The plate-shaped member 8C inhibits the liquid container 8 from bending. Also, the user can easily carry the liquid container 8 by holding the plate-shaped member 8C. Of the plate-shaped member 8C, portions that contact each of the first container end portion 81, the second container end portion 82, the third container end portion 83, the fourth container end portion 84, and the storage portion 80 of the liquid container 8 from the lower side will be referred to as a first plate end portion 81C, a second plate end portion 82C, a third plate end portion 83C, a fourth plate end portion 84C, and a plate center portion 80C, respectively.

When manufacturing the liquid storage unit 1C, the plate-shaped members 5A and 5B sandwich the liquid container 8 and the plate-shaped member 8C from both sides in the up-down direction. The plate-shaped member 5A contacts the sheet 88 of the liquid container 8 from the upper side. The plate-shaped member 5B contacts the plate-shaped member 8C from the lower side. The first plate end portion 51 of the plate-shaped member 5A and the first plate end portion 61 of the plate-shaped member 5B sandwich the first container end portion 81 of the liquid container 8 and the first plate end portion 81C of the plate-shaped member 8C from both sides in the up-down direction in a state in which the plate-shaped member 5A and the plate-shaped member 5B contact the sheet 88. The main body 31 of the spout 3 is arranged in a space surrounded by the main portions 55A and 65A of the plate-shaped members 5. The second plate end portion 52 of the plate-shaped member 5A and the second plate end portion 62 of the plate-shaped member 5B sandwich the second container end portion 82 of the liquid container 8 and the second plate end portion 82C of the plate-shaped member 8C from both sides in the up-down direction. The third plate end portion 53 of the plate-shaped member 5A and the third plate end portion 63 of the plate-shaped member 5B sandwich the third container end portion 83 of the liquid container 8 and the third plate end portion 83C of the plate-shaped member 8C from both sides in the up-down direction. The fourth plate end portion 54 of the plate-shaped member 5A and the fourth plate end portion 64 of the plate-shaped member 5B sandwich the fourth container end portion 84 of the liquid container 8 and the fourth plate end portion 84C of the plate-shaped member 8C from both sides in the up-down direction. The plate center portion 50 of the plate-shaped member 5A and the plate center portion 60 of the plate-shaped member 5B sandwich the storage portion 80 of the liquid container 8 and the plate center portion 80C of the plate-shaped member 8C from both sides in the up-down direction.

Figure 9:
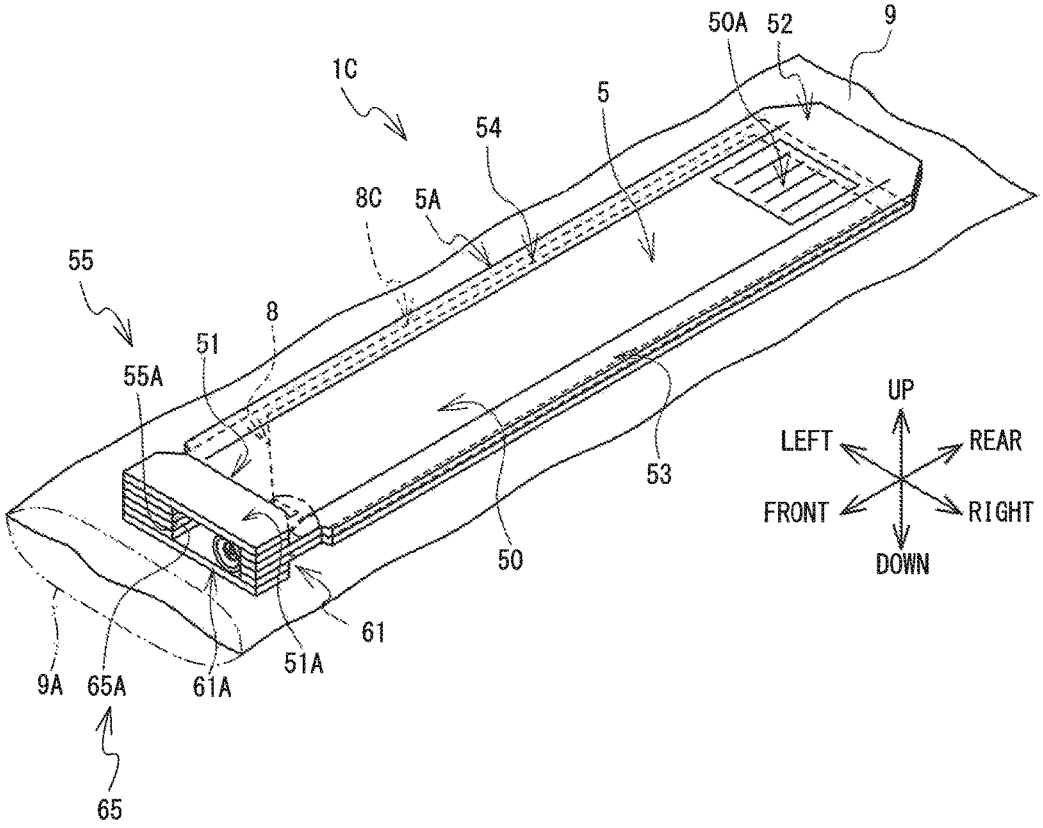
FIG. 9 is a perspective view of a liquid storage unit.

As shown in FIG. 9, the liquid container 8, the plate-shaped member 8C, and the plate-shaped members 5 are inserted into the opening 9A of the bag 9 from the rear end portion side in a state in which the plate-shaped members 5 sandwich the liquid container 8 and the plate-shaped member 8C from both sides in the up-down direction. After the entirety of the liquid container 8, the plate-shaped member 8C, and the plate-shaped members 5 are enclosed in the bag 9, the manufacturer removes the air in the bag 9 through the opening 9A. The inside surface of the bag 9 contacts the plate-shaped members 5. With this, the manufacture of the liquid storage unit 1C is completed.

[Mode of Use of the Liquid Container 8]

First, the user of the inkjet printer removes the liquid container 8, the plate-shaped member 8C, and the plate-shaped members 5 from the bag 9. Next, the user removes the liquid container 8 and the plate-shaped member 8C from the plate-shaped members 5. Then, the user mounts the liquid container 8 and the plate-shaped member 8C to the second cartridge. Next, the user installs the second cartridge in the inkjet printer (not shown in the drawings) in a state in which the liquid container 8 and the plate-shaped member 8C are mounted to the second cartridge. At this time, the third container end portion 83 of the liquid container 8 shown in FIG. 10 is arranged on the lower side, and the fourth container end portion 84 of the liquid container 8 is arranged on the upper side. Also, the liquid container 8 is arranged in a state in which the third container end portion 83 is inclined downward from the second container end portion 82 toward the first container end portion 81.

When the second cartridge is installed in the inkjet printer, a lead-out needle (not shown in the drawings) of the inkjet printer connects to the spout 3. The liquid container 8 supplies the ink inside the storage portion 80 to the inkjet printer via the lead-out needle. Note that the liquid container 8 is in a state in which the third container end portion 83 is inclined downward from the second container end portion 82 toward the first container end portion 81. Therefore, the ink in the storage portion 80 moves toward the spout 3 as the ink is supplied to the inkjet printer.

[Operation and Effects of the Second Modified Example]

In the liquid storage unit 1C, the plate-shaped members 5 and 8C can fix the container end portion 8B of the liquid container 8 by sandwiching the container end portion 8B from above and below. Therefore, the plate-shaped members 5 and 8C can inhibit the container end portion 8B from bending and thus having a bending tendency. Note that when a bending tendency is created in the container end portion 8B of the liquid container 8, the bending tendency may inhibit the movement of ink toward the spout 3, in a state in which the second cartridge to which the liquid container 8 is mounted is installed in the inkjet printer. At this time, the supply of ink to the inkjet printer may stop in a state in which the ink remains inside the storage portion 80 of the liquid container 8. However, in the liquid storage unit 1C, the bending tendency of the container end portion 8B of the liquid container 8 can be inhibited by the plate-shaped members 5 and 8C. Therefore, in the liquid storage unit 1C, the ink can move smoothly toward the spout 3. Therefore, the liquid container 8 can supply ink from the storage portion 80 toward the inkjet printer without waste.

In the second modified example, the plate-shaped member 8C need not necessarily be connected to liquid container 8. That is, in the liquid storage unit 1C, the plate-shaped members 5 may sandwich only the liquid container 8 from both sides in the up-down direction. At this time, in the liquid storage unit 1C, the plate-shaped members 5A and 5B sandwich the container end portion 8B of the liquid container 8 from both sides in the up-down direction.

[Other Modified Examples]

Various modifications can be made to the above embodiment. The liquid container 2 is not limited to being formed by thermally welding two sheets. For example, the liquid container 2 may be formed by bending a single sheet into two layers. The liquid containers 2 and 8 may be mounted directly to the inkjet printer. When mounting the liquid container 2 directly to the inkjet printer, the first spout engaging portion 33 and the second spout engaging portion 34 may be engaged with engaged portions provided on the inkjet printer. A half-cut portion or a notch to facilitate bending may be provided instead of the slits 53S, 54S, 63S, and 64S in the plate-shaped members 5. The slits 53S, 54S, 63S, and 64S need not necessarily be provided. The liquid stored in the liquid containers 2 and 8 is not limited to ink and may be another liquid such as a pretreatment agent or a discharging agent for decolorizing the color of the fabric. The first plate end portions 51 and 61 of the plate-shaped members 5 may sandwich the first container end portion 21 of the liquid container 2 in a state in which the first plate end portions 51 and 61 are extended.

The plate-shaped members 5 may sandwich at least a portion of at least one of the first container end portion 21, the second container end portion 22, the third container end portion 23, and the fourth container end portion 24 of the liquid container 2 from above and below. For example, the plate-shaped members 5 need not necessarily sandwich the second container end portion 22. For example, the plate-shaped members 5 need not necessarily sandwich the first container end portion 21. For example, the plate-shaped members 5 need not necessarily sandwich the third container end portion 23 and the fourth container end portion 24. For example, the plate-shaped members 5 need not necessarily sandwich the storage portion 20.

The through-hole 55 provided in the first plate end portion 51 of the plate-shaped member 5A may be configured by only the main portion 55A. The plate engaging portion 55B need not necessarily be provided. Similarly, the through-hole 65 provided in the first plate end portion 61 of the plate-shaped member 5B may be configured by only the main portion 65A. The plate engaging portion 65B need not necessarily be provided. At this time, the plate-shaped members 5 may contact the connection portion 21A of the first container end portion 21 of the liquid container 2. Moreover, the plate-shaped members 5 may have an engaging portion that engages with the insertion portion 32 of the spout 3, separate from the plate engaging portions 55B and 65B. The engaging portion that engages with the insertion portion 32 of the spout 3 is not limited to the through-holes formed in the plate-shaped members 5. For example, the engaging portion may have a fitting mechanism into which the insertion portion 32 of the spout 3 fits. The through-holes 55 and 65 need not necessarily be provided in the plate-shaped members 5. At this time, the plate-shaped members 5 may contact the main body 31 and the second spout engaging portion 34 of the spout 3 by sandwiching the main body 31 and the second spout engaging portion 34 of the spout 3 from both sides in the up-down direction. The through-holes 56 and 66 need not necessarily be provided in the plate-shaped members 5. At this time, the plate-shaped members 5 may contact the first spout engaging portion 33 of the spout 3 by sandwiching the first spout engaging portion 33 of the spout 3 from both sides in the up-down direction. The spout 3 of the liquid container 2 need not necessarily include the first spout engaging portion 33, the second spout engaging portion 34, and the holder 35.

The first container end portion 21 of the liquid container 2 may protrude forward of the first plate end portions 51 and 61 of the plate-shaped members 5, in a state in which the liquid container 2 is positioned with respect to the plate-shaped members 5 by the plate engaging portions 55B and 65B. The second container end portion 22 of the liquid container 2 may protrude to the rear of the second plate end portions 52 and 62 of the plate-shaped members 5. The third container end portion 23 of the liquid container 2 may protrude to the right of the third plate end portions 53 and 63 of the plate-shaped members 5. The fourth container end portion 24 of the liquid container 2 may protrude to the left of the fourth plate end portions 54 and 64 of the plate-shaped members 5.

The plate center portions 50 and 60 of the plate-shaped members 5 may be provided with through-holes. Also, at least a portion of the plate center portions 50 and 60 of the plate-shaped members 5 may be transparent member. At this time, the storage portion 20 of the liquid container 2 is exposed via the through-holes or the transparent members provided in the plate center portions 50 and 60. Therefore, the user can see the liquid container 2 from the outside. Note that the sheets 28 and 29 are transparent, so outside light can fall on the ink inside the storage portion 20. The ink can be seen from the outside through the through-holes or the transparent members. Therefore, the user can see the color, state, and the like of the ink by visually confirming the storage portion 20 from the outside via the through-holes or the transparent members.

The second plate end portions 52 and 62 of the plate-shaped members 5 need not necessarily have a tapered shape. The length in the left-right direction of the second plate end portions 52 and 62 may be the same along the front-rear direction.

The cardboard that forms the plate-shaped members 5 may be single-sided cardboard, double-sided cardboard, or covered double-sided cardboard. The core 59 may extend in the front-rear direction, or may extend in a direction inclined with respect to the front-rear direction and the left-right direction. For example, in the cardboard used for the plate-shaped members 5, the mountain portions 59A and the valley portions 59B that extend in the left-right direction need not necessarily be alternately arranged in the front-rear direction. For example, the mountain portions and the valley portions need only be arranged alternating in a predetermined direction other than the front-rear direction. At this time, the strength of the cardboard is stronger in a direction intersecting the predetermined direction. For example, the plate-shaped members 5 may be the backing of a blister pack. Also, a resin cover of the blister pack may surround the liquid container 2 and be mounted to the plate-shaped members 5 that are the backing. At this time, the liquid container 2 can be inhibited from shifting with respect to the plate-shaped members 5 by the resin cover. Also, the user can easily visually confirm the inside by using a transparent or semitransparent blister pack. Moreover, the plate-shaped members 5 are not limited to cardboard and may be made of other material.

The liquid information 50A and 60A may be printed on the bag 9. Also, a slip of paper on which the liquid information 50A and 60A is printed may be inserted between the plate-shaped members 5 and the bag 9.

In the liquid storage unit 1B, a connecting portion that connects the second plate end portions 72 and 77 may be provided, instead of the connecting portion 7A that connects the third plate end portions 73A and 78A. That is, the connecting portion may connect the rear ends of the second plate end portions 72 and 77 together. At this time, in the liquid storage unit 1B, the second container end portion 22 of the liquid container 2 can be inhibited from protruding to the rear with respect to the first plate-shaped portion 70 and the second plate-shaped portion 75 by the connecting portion that connects the rear ends of the second plate end portions 72 and 77 together. Therefore, in the liquid storage unit 1B, the second container end portion 22 of the liquid container 2 can be inhibited from bending and thus having a bending tendency along the entire region of the second container end portion 22.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A liquid storage unit comprising:

a liquid container provided with a storage portion that is configured to store a liquid inside a flexible sheet, the flexible sheet extending in a first direction along a surface of the sheet and a second direction orthogonal to the first direction, a length of an end portion of the flexible sheet in an orthogonal direction being shorter than a length of the flexible sheet in the first direction and a length of the flexible sheet in the second direction, the orthogonal direction being a direction orthogonal to the first direction and the second direction;

a spout provided on the liquid container, and configured to supply the liquid stored in the storage portion to an inkjet printer in a state in which the spout is connected to the inkjet printer;

a plate-shaped member configured to sandwich at least a portion of the end portion of the liquid container from both sides in the orthogonal direction; and a bag having a flexibility, and configured to enclose the liquid container and the plate-shaped member, an inside surface of the bag being configured to contact the plate-shaped member and the plate-shaped member receiving forces from the bag in a state in which the plate-shaped member comes into contact with the at least the portion of the liquid container from both sides in the orthogonal direction, when the bag is depressurized.

2. The liquid storage unit according to claim 1, wherein the liquid container includes:

a first end portion that is an end portion on one side in the first direction;

a second end portion that is an end portion on other side in the first direction;

a third end portion that is an end portion along the surface of the sheet on one side in the second direction; and a fourth end portion that is an end portion on other side in the second direction, the spout is provided on the first end portion, and the plate-shaped member is configured to sandwich at least one of the first end portion, the second end portion, the third end portion, and the fourth end portion from both sides in the orthogonal direction.

3. The liquid storage unit according to claim 2, wherein the plate-shaped member is configured to sandwich the second end portion of the liquid container from both sides in the orthogonal direction.

4. The liquid storage unit according to claim 3, wherein the plate-shaped member is configured to sandwich the storage portion of the liquid container from both sides in the orthogonal direction.

5. The liquid storage unit according to claim 3, wherein the length in the second direction of the end portion on the other side in the first direction of the plate-shaped member becomes shorter toward the other side in the first direction.

6. The liquid storage unit according to claim 2, wherein the plate-shaped member is configured to sandwich at least one of the third end portion and the fourth end portion of the liquid container from both sides in the orthogonal direction.

7. The liquid storage unit according to claim 2, wherein the plate-shaped member is configured to sandwich the first end portion of the liquid container from both sides in the orthogonal direction.

8. The liquid storage unit according to claim 7, further comprising:

a spout engaging portion configured to fix the position of the spout of the liquid container, wherein the plate-shaped member has a shape that does not sandwich the spout engaging portion.

9. The liquid storage unit according to claim 7, wherein the plate-shaped member has a shape that does not sandwich, of the first end portion of the liquid container, a connection portion that connects with the spout.

10. The liquid storage unit according to claim 9, wherein the plate-shaped member includes a plate engaging portion that engages with the spout, and the second end portion of the liquid container does not protrude, in a state in which the spout is engaged with the plate engaging portion, to the other side in the first direction with respect to the plate-shaped member.

11. The liquid storage unit according to claim 2, wherein the plate-shaped member is made of cardboard, and the cardboard has a wavy-shaped core in which mountain portions and valley portions that extend along a predetermined direction are alternately arranged.

12. The liquid storage unit according to claim 11, wherein the predetermined direction is the second direction.

13. The liquid storage unit according to claim 2, wherein the plate-shaped member includes:

a first plate-shaped portion configured to sandwich the third end portion of the liquid container from one side in the orthogonal direction;

a second plate-shaped portion configured to sandwich the third end portion of the liquid container from other side in the orthogonal direction; and a connecting portion configured to connect the first plate-shaped portion with the second plate-shaped portion at one of both sides of the liquid container in the second direction.

14. The liquid storage unit according to claim 1, wherein the plate-shaped member includes a window through which outside light falls on the liquid stored in the spout.

15. The liquid storage unit according to claim 1, wherein the plate-shaped member is made of cardboard.

16. The liquid storage unit according to claim 1, wherein the plate-shaped member is backing of a blister pack.

17. The liquid storage unit according to claim 1, wherein information related to the liquid stored in the storage portion of the liquid container is provided on one of the plate-shaped member and the bag.

18. A liquid storage unit comprising:

a liquid container provided with a storage portion that is configured to store a liquid inside a flexible sheet, the flexible sheet extending in a first direction along a surface of the sheet and a second direction orthogonal to the first direction, a length of an end portion of the flexible sheet in an orthogonal direction being shorter than a length of the flexible sheet in the first direction and a length of the flexible sheet in the second direction, the orthogonal direction being a direction orthogonal to the first direction and the second direction;

a spout provided on the liquid container;

a plate-shaped member configured to sandwich at least a portion of the end portion of the liquid container from both sides in an orthogonal direction that is orthogonal to the surface of the flexible sheet; and a bag having a flexibility, and configured to enclose the liquid container and the plate-shaped member, an inside surface of the bag being configured to contact the plate-shaped member and the plate-shaped member receiving forces from the bag in a state in which the plate-shaped member comes into contact with the at least the portion of the liquid container from both sides in the orthogonal direction, when the bag is depressurized.

* * * * *